United States Patent [19]

Uneo et al.

[11] Patent Number: 4,810,121

[45] Date of Patent: Mar. 7, 1989

[54] CHARACTER ERASABLE PRINTING APPARATUS

[75] Inventors: Hideo Uneo; Hiroshi Hattori; Shigeto Yamada, all of Nagoya; Shigeto Yamada, Aichi, all of Japan

[73] Assignee: Brother Kogyo Kabushiki Kaisha, Aichi, Japan

[21] Appl. No.: 60,347

[22] Filed: Jun. 10, 1987

[30] Foreign Application Priority Data

| | | | |
|---|---|---|---|
| Jun. 13, 1986 | [JP] | Japan | 61-138622 |
| Jun. 13, 1986 | [JP] | Japan | 61-138623 |
| Jun. 13, 1986 | [JP] | Japan | 61-138624 |
| Jun. 13, 1986 | [JP] | Japan | 61-138626 |

[51] Int. Cl.[4] ..... B41J 29/26

[52] U.S. Cl. ..... 400/697.1; 400/63

[58] Field of Search ..... 400/697.1, 63, 697, 400/95, 98

[56] References Cited

U.S. PATENT DOCUMENTS

| | | | |
|---|---|---|---|
| 3,780,846 | 12/1973 | Kolpek et al. | 400/63 |
| 4,480,931 | 11/1984 | Kamikura et al. | 400/697 |
| 4,492,485 | 1/1985 | Gall | 400/697.1 |
| 4,561,793 | 12/1985 | Blanchard | 400/697.1 |
| 4,580,241 | 4/1986 | Kucera | 400/98 |
| 4,678,351 | 7/1987 | Curley | 400/697 |

FOREIGN PATENT DOCUMENTS

| | | | |
|---|---|---|---|
| 151386 | 3/1981 | Japan | 400/697.1 |

*Primary Examiner*—William Pieprz

*Attorney, Agent, or Firm*—Barnes & Thornburg

[57] ABSTRACT

A printing apparatus including an erasing mechanism capable of erasing a misprinted character or character string by utilizing a correction ribbon, a well as a reprint control means capable of reprinting the character or character string erased by mistake is disclosed.

In order to realize reprint with a simple operation, a simple memory and a simple control, an erase data memory storing the erased data and the reprint control means were disposed besides the erasing mechanism.

The reprint control means reprints the characters including the following the character to which a print head is corresponding among the erased character string at respective position from there previously erased, or reprints all characters of the character string corresponding to the print head at the position from there previously erased, or reprints only the lastly erased character string at a specified position or the position from there previously erased, or when a print character is at a reprint position. reprints after automatically erasing such print character.

10 Claims, 18 Drawing Sheets

CHARACTER ERASABLE PRINTING APPARATUS

BACKGROUND OF THE INVENTION

The present inventions relate to a printing apparatus, more specifically, they relate to the printing apparatus having an erasing mechanism erasing a character, and being adapted to reprint an erased character string by an erase cancel command.

Most recent electronic typewriters and the like, are provided with a present position memory storing a present position of a print head and a print data memory storing a printed data inputted from a key-board in its control system, and including an erasing mechanism sequentially erasing the character string consisting of a set of printed characters in the counter printing direction with a correction ribbon by utilizing the data from said present position memory and print data memory according to operation of an erase command key on the key-board. For example, in U.S. Pat. No. 4,561,793, An Automatic Word Correcting System is disclosed.

When printing an article and the like on a print paper with the printing apparatus including such erasing mechanism, if the character string is erased by misoperation or the like, the character string must be reprinted.

For Example, U.S. Pat. No. 4,480,931 discloses a typewriter provided with an output buffer for storing data of the character string of about two lines, a correct buffer for storing the erased character string data, a key code register and other various registers and buffers. These are controlled to print a character or symbol corresponding to a character or symbol key operated, as well as to store the character or symbol data in the output buffer via the key code register, to erase the character indicated by the print head by operating an erase key on the key-board, to automatically erase serial character strings in the counter printing direction by using the erase key and a repeat key together, to store the erased character string data in the correct buffer, and when necessary, to automatically reprint the character string corresponding to the data stored in the correct buffer in the printing direction from the present position of the print head by operating a print key.

In the correct buffer, serial erased character data corresponding to about two lines can be stored, but it is not possible to store a plurality of character strings sequentially and sequentially.

In the typewriter disclosed in U.S. Pat. No. 4,480,531, when automatically erasing the serial character string by using the erase key and repeat key together, the character string, not required to be erased following the character string desired to be erased may be erased in excess by misoperation.

In this case, the character string erased by misoperation is printed again by character or symbol key operation, otherwise the erased character string is fully reprinted at the print positions from which they were previously erased and then only the misprinted character string is erased. These steps result in complicated operation and reduction of operating efficiency.

Also, when reprinting the character string erased by misoperation at the previous print position, the print head must be moved precisely at the head print position of the erased character string by means of a back space key or a space key before reprinting, thus causing complicated and time consuming reprint operation.

In such case as erasing two character strings and mutually exchanging the print positions to reprint, one of two character strings can be reprinted at the desired position, but the other character string must be printed by repeating the key input.

Also, when reprinting the data stored in the correct buffer and when there is a printed character at the print position of the character string to be reprinted, it must be reprinted after erasing the character in advance, thus causing complicated operation.

When reprinting the erased character string at the previous print position, since reprinting is allowed irrespective of presence or kind of operation of a printing mechanism after the erasing operation, a control for bringing the moved print head to correspond to the print position to be reprinted or a control program for reprinting is complicated.

Meanwhile, in U.S. Pat. No. 3,780,846, an Automatic Erasing Typewriter System designed to erase in a character, word and line unit for adding, correcting and erasing the character or word among which a desired one can be reprinted is disclosed.

However, (a) when the erase command is inputted, since character, word and line modes must be specified or "ERASE" and "ERASE and DELETE" modes must be specified, the number of mode is increased and the key operation is complicated. (b) Since bits for storing information such as "Useful information", "Symbol not appear" and so on are required in bytes of each character or symbol in the memory, a data construction of the memory is complicated and a necessary memory capacity is enlarged. (c) When erasing the character or word and moving it in a printing direction by a prescribed distance to reprint, a number of space code data must be inputted after erasing to reprint at the desired position. (d) After erasing the character or word, when the new character or word is printed at its position to reprint, since erase control and reprint control of the new character or word is not interlocked, the number of key operation is increased.

The first object of the present invention is to reprint partially or fully a character string erased wrongly by misoperation at original print positions.

The second object of the present invention is to reprint sequentially the desired character string among plural erased character strings at the desired space respectively with changed or unchanged disposition.

The third object of the present invention is to reprint sequentially the desired character string among plural erased character strings at the original space.

The fourth object of the present invention is to simplify the reprint control and operation for reprinting one or more erased character strings.

SUMMARY OF THE INVENTION

In an electronically controlled character erasable printing apparatus having inputting means, a printing mechanism, a print data memory, a present position memory, an erasing mechanism for erasing printed characters and the like; the present invention is provided with an improvement comprising an erase data memory for storing data of one or more erased character strings corresponding to respective print positions and/or erase sequence and reprint control means for controlling the printing mechanism to reprint partially or fully the erased character string at original space, or to reprint fully the erased one or more character string at the original space or other indicated space.

Preferably, the reprint control means controls the printing mechanism so as to reprint the characters including and following the character corresponding to the print head of the erased character string.

Preferably, the reprint control means controls the printing mechanism so as to move the print head to the print position of the head character of the erased character string, and to reprint the character including and following the head character of the erased character string at the print position from there previously erased.

The first aspect of the present invention is to reprint partially or fully one erased character string at the original print positions.

The print data memory stores the data printed on the print paper by the printing mechanism corresponding to the print position, and the present position memory stores the present position of the print head corresponding to the print position. THen, when the erasing mechanism receives the erase command signal, on the basis of data of the print data memory and present position memory, the printed character is erased sequentially to erase the character string (or a character) consisting of a set of characters. The data of the erased character string is stored in the erase data memory corresponding to the print position.

When the reprint control means receives the erase cancel command signal, and when the print head is corresponding to the print position of any character of the erased character string, on the basis of data of the present position memory and erase data memory, the printing mechanism is controlled and at least a part of characters of the erased character string is reprinted at the print position from there erased.

In the case of this reprint, the character including and following the character corresponding to the print head is reprinted, or the print head is moved to the print position of the head character of the erased character string to reprint the character thereon and thereafter.

Accordingly, when the character string not required to be erased following the lower order in the printing direction of the character string to be erased is erased by misoperation, the wrongly erased character string can be reprinted by a simple operation of moving the print head to its head position.

In the erase data memory, the data of erased character string is stored corresponding to the print position, so that a control for bringing the wrongly erased character string to correspond to the print position to be reprinted is not complicated and besides the operability may be improved.

In addition, when reprinting the whole character string erased by misoperation at the previous print position, it can be reprinted by a simple operation of moving the print head to the position corresponding to the print position of any character of the wrongly erased character string.

Since the erased character string data is stored in the erase data memory corresponding to the print position, control for bringing the wrongly erased character string to correspond to the print position to be reprinted is not complicated and besides the operability may be improved.

Function of the printing apparatus according to the present second invention is different from that of the present first invention particularly in the reprint control means.

That is to say, when the reprint control means receives the erase cancel or reprint command signal, it controls the printing mechanism and reprints the lastly erased character string stored in the erase data memory in sequence from the erased character strings at the print positions including and following the print position corresponding to the present print head.

When controlling to erase the data of reprinted character string from the erase data memory, wherein the data of lastly reprinted character string is erased, so that the data of the character string stored before the lastly reprinted data becomes the lastly erased character string, which can be reprinted similarly as aforementioned.

Accordingly, the latest of a plurality of erased character strings is reprinted sequentially at the desired print position.

Thus, even in such case as reprinting by mutually exchanging print positions of the two character strings, reprinting can be conducted by replacing the two character strings.

When it is constituted to reprint the print character at the print position to be reprinted after erasing, erasing operation of the printed character is not necessary in advance, resulting in a simple reprinting operation.

Function of the printing apparatus according to the present third invention is different from that of the present first invention in the function of the reprint control means.

That is to say, the reprint control means, when receiving the erase cancel or reprint command, on the basis of the data of the present position memory and erase data memory, controls the printing mechanism and reprints the erased character strings at the original print positions from which they were erased.

In the case of reprinting, it is executed only when the key input is not made after starting erasing operation, or only when the print head is not moved after completing erasing operation.

Moreover, in the case of reprinting, when the printed character is at the print position to be reprinted, it is executed after controlling the erasing mechanism to erase the printed character, or only the lastly erased character string is reprinted.

Accordingly, since the data of erased character string is stored in the erase data memory corresponding to the print position, control for bringing the erased character to correspond to the print position to be reprinted is simplified and operability can be improved.

Also, in case of controlling the erased character string so as to be reprinted at the print positions from which they were previously erased only when the key is not operated from the input means after starting the erasing operation, reprinting is operated after the erasing operation, thus control with respect to the reprint control can be simplified.

Then, in case of controlling the erased character string so as to be reprinted at the print positions from which they were previously erased when the print head is not moved after completing the erasing operation, control with respect to the reprint control such as control for bringing the print head to correspond to the print position to be reprinted can be simplified.

Moreover, in case of sequentially, storing the data of a plurality of character strings in the erase data memory corresponding to the print position, the lastly erased character string of the plural character strings stored in the erase data memory can be sequentially reprinted at the print positions form which they were previously erased.

DESCRIPTION OF THE DRAWINGS

The drawings show the embodiments of the present inventions.

THE DESCRIPTION OF THE PREFERRED EMBODIMENT

The embodiments of the present invention will be described with reference to the drawings as follows.

In the embodiments, the present inventions are applied to an electronic typewriter 1, wherein by operating a correction key 23 (an erase command key) for erasing characters provided on a key-board 3 of the typewriter 1, when a character string of misprinted characters is erased with an erasing mechanism including an erase ribbon 20, in the case such erasing is found to be erroneous, the erased characters or character string are reprinted when necessary.

Figure 1:
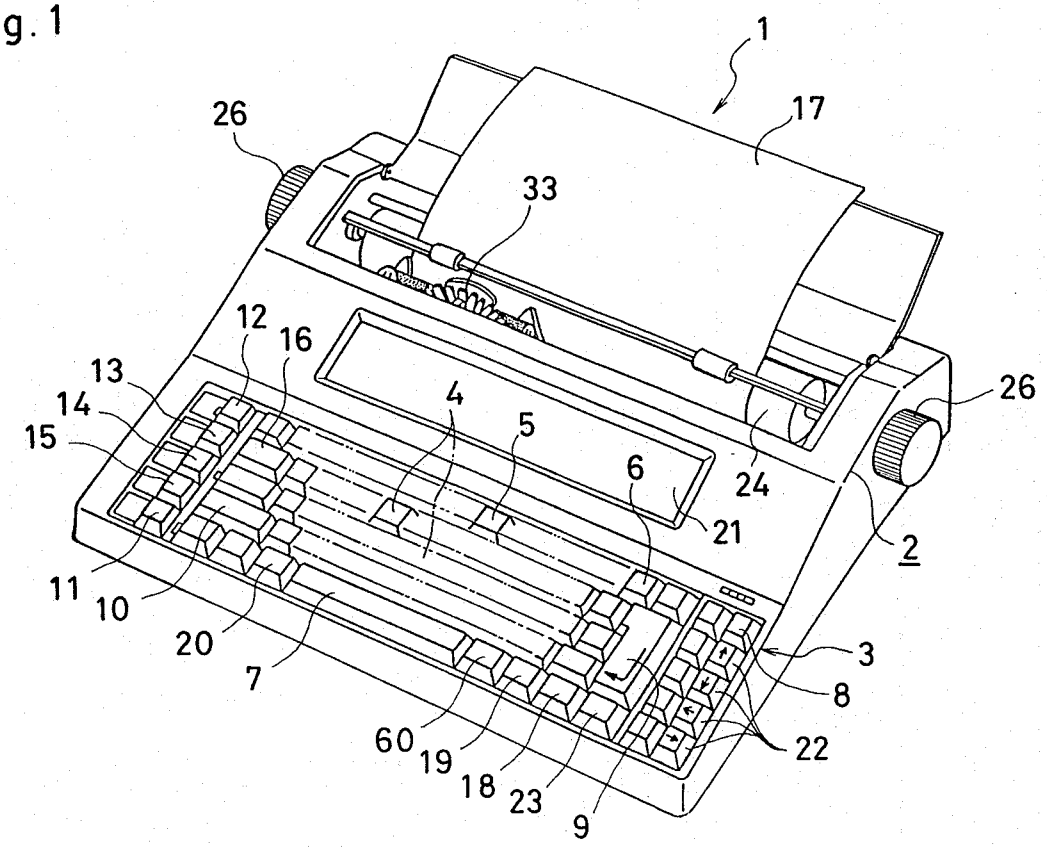
FIG. 1 is a perspective view of an electronic typewriter.

In front of a main frame 2 of the typewriter 1, as shown in FIG. 1, there is arranged the key-board 3, on the rear side of which in the main frame 2, a printing mechanism is disposed.

On the key-board 3, following various keys are disposed. That is to say, character keys including alphabetic keys 4, numeral keys 5 and symbol keys 6, a space key 7, a back space key 8, a return key 9, a shift key 10, a code key 11, a left margin set key 12, a right margin set key 13, a tab set key 14, a tab clear key 15, a tab key 16, a paper feed key 18, a paper return key 19, a repeat key 20, a cursor shift key 22 for shifting a cursor showing the data input position on a display 21, a correction key 23 outputting the erase command signal, a correction cancel key 60 (erase cancel or reprint command key) for reprinting the erased character string on a print paper 17 and the like.

Explanation on each function obtained from operating the various keys will be omitted as it is as same as the conventional typewriter.

On the rear part of the key-board 3, the display 21 is provided for displaying characters or symbols inputted by operating the character keys 4, 5, 6 and the space key 7 and the like. A platen 24 is disposed to move left and right in the main frame 2 and driven automatically or manually by means of a platen drive motor 25 or a platen knob 26 to feed the print paper 17.

Figure 2:
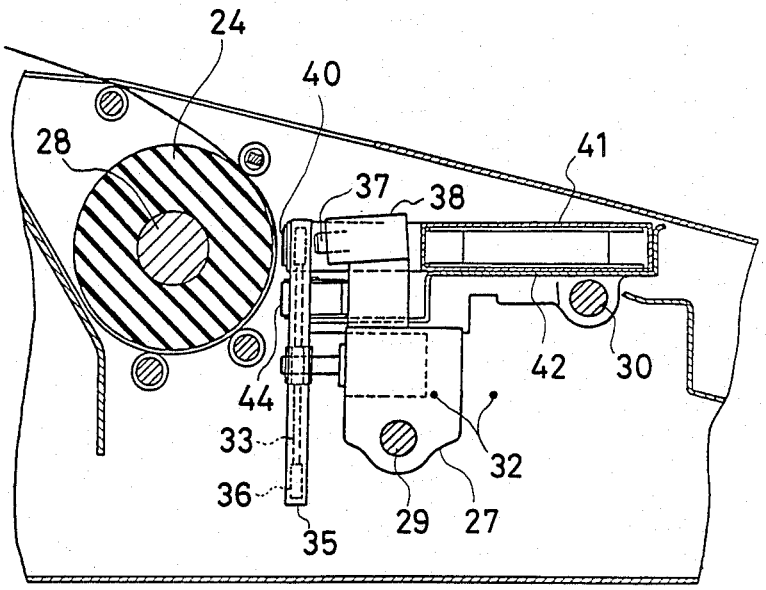
FIG. 2 is a vertical sectional side view of the essential part of the typewriter of FIG. 1.

Also, a carriage 27 is supported by two guide shafts 29, 30 disposed in parallel to a platen shaft 28 as shown in FIG. 2, and driven in both directions in reciprocating movement along the platen 24 by means of a wire 32 driven with a carriage drive motor 31.

On the carriage 27, there is provided a type wheel drive motor 34 driving a type wheel 33, and on its motor shaft, the type wheel 33 contained in a wheel cassette 35 is mounted removably and driven rotatably, so that a type 36 on the tip of a selected spoke of the type wheel 33 is set at the print position opposing a print hammer 37. The print hammer 37 is mounted at the top of the carriage 27 and its print hammer solenoid 38 is driven by a drive current from a print hammer solenoid driver 39 to be described later to hit the type 36 set at the print position against the print paper 17.

A ribbon cassette 41 containing a print ribbon 40 is placed on a holder 42 whose front end is mounted pivotably to the carriage 27, the print ribbon 40 is fed from a feed spool of the ribbon cassette 41 and wound on a winding spool, which is driven by a ribbon feed motor 43. Also, at a lower portion formed on the rear part of the holder 42, a correction ribbon 44 is provided. On the right side of the ribbon cassette 41, a feed spool for feeding the correction ribbon 44 is disposed and on the left side, a winding spool for winding the same is disposed.

Moreover, in order to change between the print position (refer to FIG. 2) where the print ribbon 40 is positioned between the type 36 at the print position and the platen 24, the recess position (not shown) where the print ribbon 40 is moved downward from the print position and the correcting position (refer to FIG. 3) where the correction ribbon 44 is positioned between the type 36 at the print position and the platen 24, a cam mechanism not shown herein, but as can be seen from U.S. Pat. Nos. 4,533,267 and 4,728,208, coupled to a drive shaft (not shown) driven by a ribbon lift motor 45 to swing the holder 42 to the three positions described above is mounted on the carriage 27.

Furthermore, on the carriage 27 and the holder 42, a correction ribbon winding mechanism (not shown) for winding the correction ribbon 44 from the feed spool onto the winding spool as the holder 42 is swing to the correction position is disposed.

Thus, the printing mechanism is constituted by the platen 24 and its drive unit, the carriage 27 and its drive unit, the type wheel 33 and its drive unit, the print ribbon 40 and its feed drive unit, the cam mechanism and its drive unit for swinging the print ribbon 40 and the correction ribbon 44 to the print position, the print hammer 37 and its drive unit, and each drive unit of the printing mechanism is connected to a CPU (Central Processing Unit) 46 of a control system.

Figure 4:
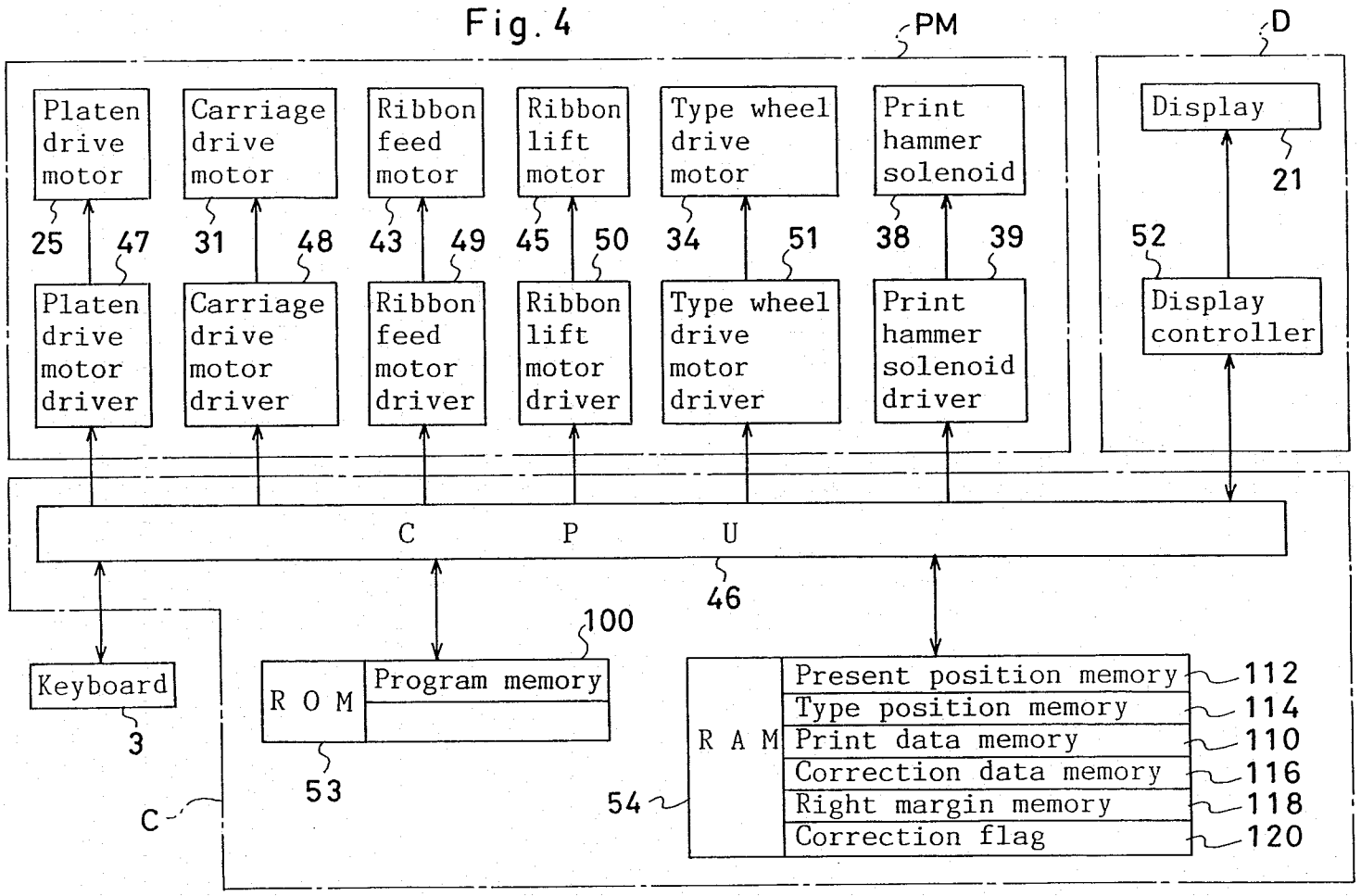
FIG. 4 is a block diagram of a control system of the typewriter of FIG. 1, FIG. 5(*a*), (*b*) and (*c*) are explanatory views showing relationship between printed characters, data in a print data memory and a correction data memory in each step respectively from correction to reprinting in a first example of a reprint control.

Next, a general construction of the control system of the typewriter 1 will be described with reference to a block diagram of FIG. 4.

A drive means PM of the printing mechanism comprises the platen drive motor 25 and its driver 47, the carriage drive motor 31 and its driver 48, the ribbon feed motor 43 and its driver 49, the ribbon lift motor 45 and its driver 50, the type wheel driver motor 34 and its driver 51, the print hammer solenoid 38 and its driver 39 and the like.

A display unit D comprises the display 21 consisting of a liquid crystal display and a display controller 52, which stores display data for displaying characters or the like on the display 21 corresponding to the code data of each character or symbol, and the display data corresponding to the code data inputted thereinto is outputted to the display 21.

The control system C comprises the CPU 46, a ROM (Read Only Memory) 53 and a RAM (Random Access Memory) 54 connected to the CPU 46, to which the key-board 3, each driver 39, 47–51 of the drive means PM and the display controller 52 are connected.

In the ROM 53, a program memory 100 storing a control program controlling each motor 25, 31, 34, 43, 45 and the print hammer solenoid 38 and the display 21 corresponding to the code data of each character or the like inputted from the character keys 4, 5, 6 and space key 7 and the like on the key-board 3, or the code data read from a print data memory 110 of RAM 54, a control program controlling each motor 25, 31, 34, 43, 45 and the print hammer solenoid 38 corresponding to the code data of each function inputted from various function keys on the key-board 3, a control program of character erase control and a control program of reprint control to be described later and the like is disposed.

The RAM 54 is provided with the print data memory 110 sequentially storing the printed data corresponding to the print position, a present position memory 112 storing the present position of the carriage 27 corresponding to the print position, a type position memory 114 storing a spoke number of the type 36 at the present rotation angle position of the type wheel 33 or at the print position, a correction data memory (an erase data memory) 116 storing the erased character string data corresponding to the print position, a right margin memory 118 storing the right margin set position, a correction flag 120 where "0" is written and reset when any of the keys on the key-board 3 is operated after completing correction operation and various memories temporarily storing the result processed in the CPU 46.

The CPU 46, on the basis of the code data corresponding to each character or symbol such as alphabets, numerals, spaces and symbols inputted from the character keys 4, 5, 6 and space key 7 on the key-board 3, prints on the print paper 17 with the printing mechanism, and sequentially stores the printed data in the print data memory 110 in the RAM 54 corresponding to the print position, as well as stores the present position data changed whenever the carriage drive motor 31 or type wheel drive motor 34 is driven in the present position memory 112 and the type position memory 114 in the RAM 54.

Then, the CPU 46 processes the code data inputted from various function keys on the key-board 3 by the control program read out from the program memory 100 in the ROM 53 to output the control signal corresponding to input code data to the each driver 39, 47–51 and the display controller 52.

Furthermore, the CPU 46 processes the code data inputted from the character keys 4, 5, 6 and space key 7 on the keyboard 3 or the code data of characters and symbols read out from the print data memory 110 by the control program read out from the program memory 100 in the ROM 53. Thereby, outputting the control signal corresponding to the code data to each driver 39, 47–51 of the printing mechanism drive means PM or to the display controller 52 to control the printing mechanism and the display unit D.

That is to say, when controlling the printing mechanism drive means PM on the basis of code data, the control signal is outputted from the CPU 46 to the type wheel drive motor driver 51, from which a drive current is outputted to the type wheel drive motor 34. Then, the type wheel drive motor 34 is rotated by a prescribed angle and the type 36 of the type wheel 33 corresponding to the code data is set at the print position in front of the print hammer 37, and simultaneously, the control signal is outputted from the CPU 46 to the ribbon lift motor driver 50, from which a drive current is outputted to the ribbon lift motor 45, which rotates to swing the holder 42 and print ribbon 40 to the print position of FIG. 2 through a drive shaft and a cam mechanism.

Then, when the control signal is outputted from the CPU 46 to the print hammer solenoid driver 39, from which a drive current is outputted to the print hammer solenoid 38 and the type 36 of the type wheel 33 is hit by the print hammer 37, thus the character or symbol is printed on the print paper 17.

When there is no further key input in a prescribed time, the control signal is outputted from the CPU 46 to the ribbon lift motor driver 50, whereby the ribbon lift motor 45 is rotated and the holder 42 and print ribbon 40 are returned to the recess position. Moreover, the control signal is outputted from the CPU 46 respectively to the carriage drive motor driver 48 and ribbon feed motor driver 49.

Meanwhile, a drive current is outputted from the carriage drive motor driver 48 to the carriage drive motor 31, which rotates by a prescribed amount to move the carriage 27 in the printing direction by one character via the wire 32. On the other hand, a drive current is outputted from the ribbon feed motor driver 49 to the ribbon feed motor 43, which rotates by a prescribed amount to feed the print ribbon 40.

Also, when the return key 9 is operated, the CPU 46, by processing the code data from the key-board 3 with the control program read out from the program memory 100 in the ROM 53, outputs the control signal to the carriage drive motor driver 48 and platen drive motor driver 47. Then, a drive current is outputted from the carriage drive motor driver 48 to the carriage drive motor 31, which is rotated reversely to return the carriage 27 to the print start position. At the same time, the drive current is outputted from the platen drive motor driver 47 to the platen drive motor 25, which is rotated by a prescribed amount to feed the print paper 17 by one line.

Figure 3:
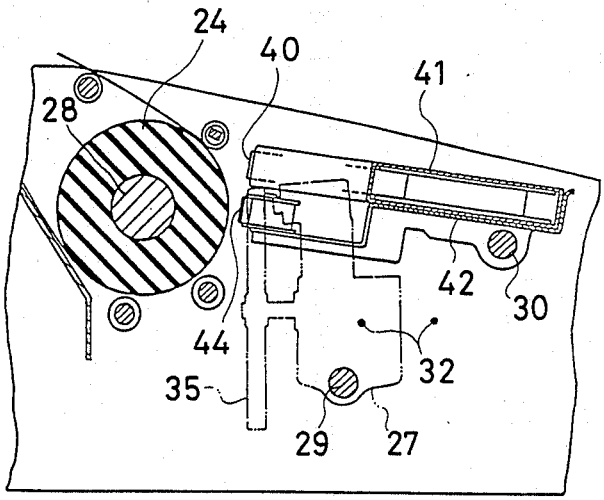
FIG. 3 is a view corresponding to FIG. 2 showing a holder of the typewriter of FIG. 1 being placed at a correcting position.

In addition, when operating the correction key 23 to erase characters, the CPU 46 reads the character erase control program from the program memory 100 in the ROM 53 and outputs the control signal to the ribbon lift motor driver 50, whereby the ribbon lift motor 45 is rotated and the holder 42 is swung to the correcting position of FIG. 3. Then, the CPU 46 sequentially reads the data of the print data memory 110 corresponding to the print position of print head on the basis of data of the present position memory 112 in the RAM 54, and outputs the control signal to the type wheel drive motor driver 51, whereby the type wheel drive motor 34 rotates the type wheel 33 and the type 36 which is as same as the character or symbol to be erased is positioned at the print position, the print hammer solenoid 38 is driven by the drive current from the print hammer solenoid driver 39 to hit the print hammer 37 and to erase the printed character on the print paper 17.

In addition, when the code key 11 and correction key 23 are operated simultaneously, as described above, the printing apparatus is controlled and a word corresponding to the print head is erased sequentially from the end character in the counter printing direction in a word unit.

Now, examples of reprint control for reprinting erased characters or a character string after erasing the desired character string will be described as follows. [Example 1 of the reprint control] (FIG. 5–FIG. 8)

In the reprint control, the data of character string erased (corrected) by operating the correction key 23 is stored in the correction data memory 116 corresponding to the print position, and by operating the correction cancel key 60, a character or characters including and following the character printed at the print position to which the print head at the time of correction cancel command is corresponding, is reprinted on the basis of data stored in the correction data memory 116.

For a better understanding of the explanation of flow charts, the outline of reprint control will be described.

Figure 5:
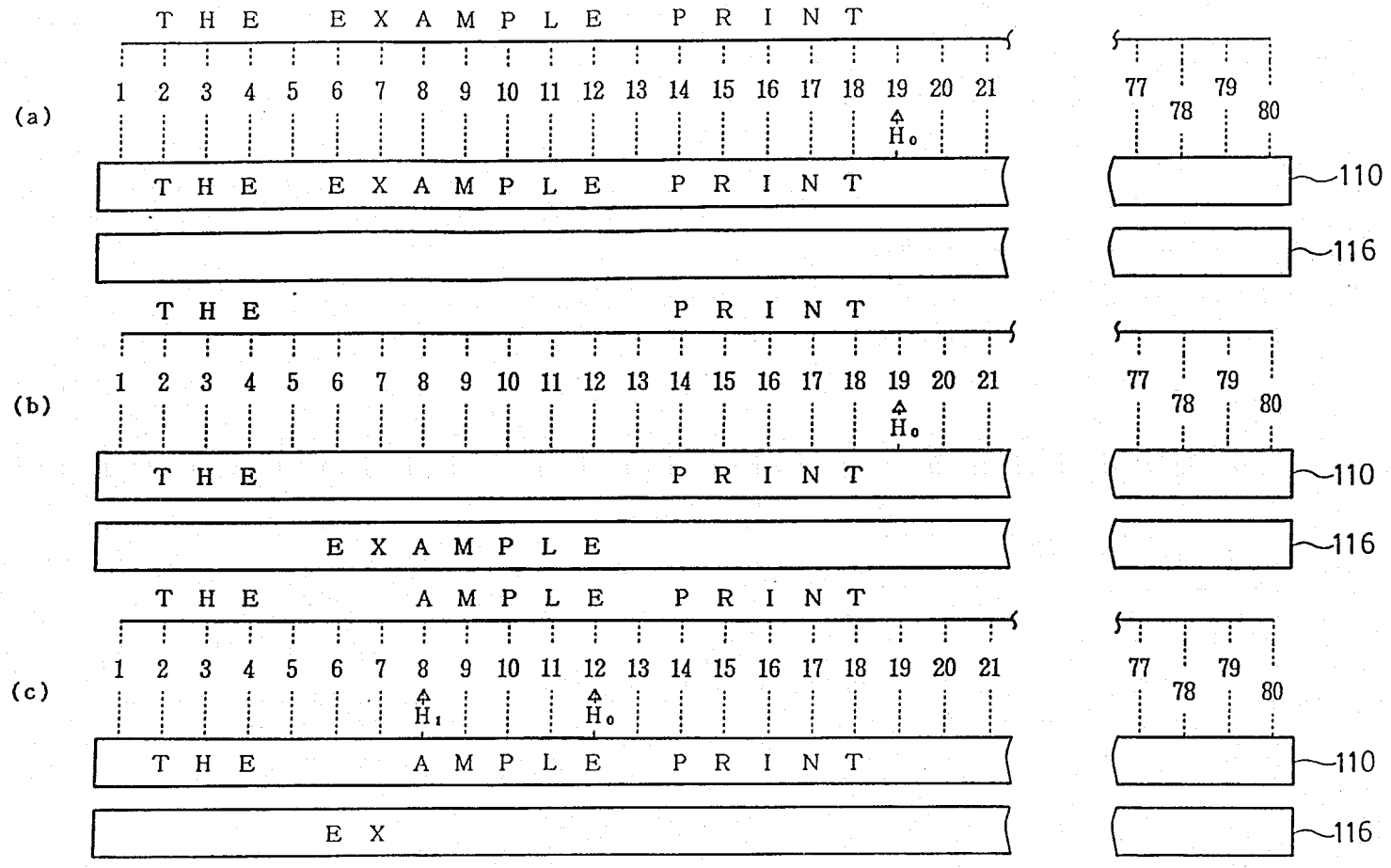

FIG. 5(*a*) visually shows the character string printed as "THE EXAMPLE PRINT" as one example corresponding to the data in the print data memory 110 and that in the correction data memory 116.

As shown in FIG. 5(*b*), the print head is moved from $H_O$ at 19th digit to 12th digit and the correction key 23 is continuously pressed to erase the character string "EXAMPLE" extending from 12th digit to 6th digit. At this time, the CPU 46 reads the erase processing control program from the program memory 100, repeats to print the same character upon the printed character at the print position corresponding to the present print head through the correction ribbon 44, and sequentially erases the character string "EXAMPLE" in the counter printing direction. Then, the erased character string "EXAMPLE" is stored in the correction data memory 116 corresponding to the print position.

Next, when the print head is moved, for example, to 8th digit (position $H_1$) to operate the correction cancel key 60, as shown in FIG. 5(*c*), the CPU 46 reads the reprint processing control program for the program memory 100, and reprints the character string "AMPLE" including and following 8th digit among the character string "EXAMPLE" stored in the correction data memory 116 at the respective print positions from there previously erased.

Then, the data of the correction data memory 116 corresponding to the reprinted character string "AMPLE" are deleted.

Meanwhile, the character in print memory 110 represents a set of one or a plurality of characters, that is, a part of word or one word or plural words. Thus, the character string may be extending one print line or, comprising only one character as a peculiar example.

Figure 6:
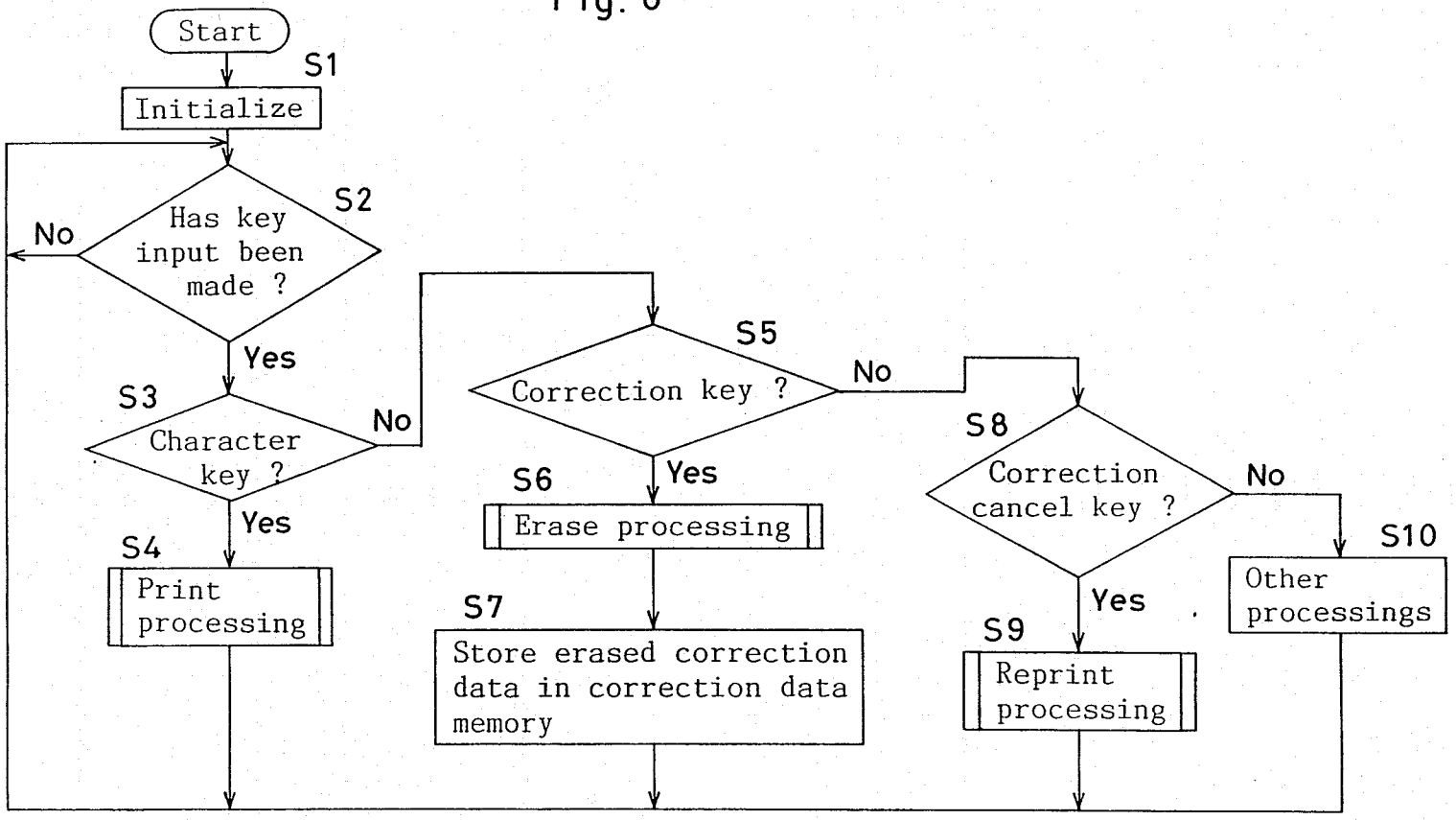
FIG. 6 is a schematic flow chart of a reprint control routine in the first example of the reprint control.
Figure 7:
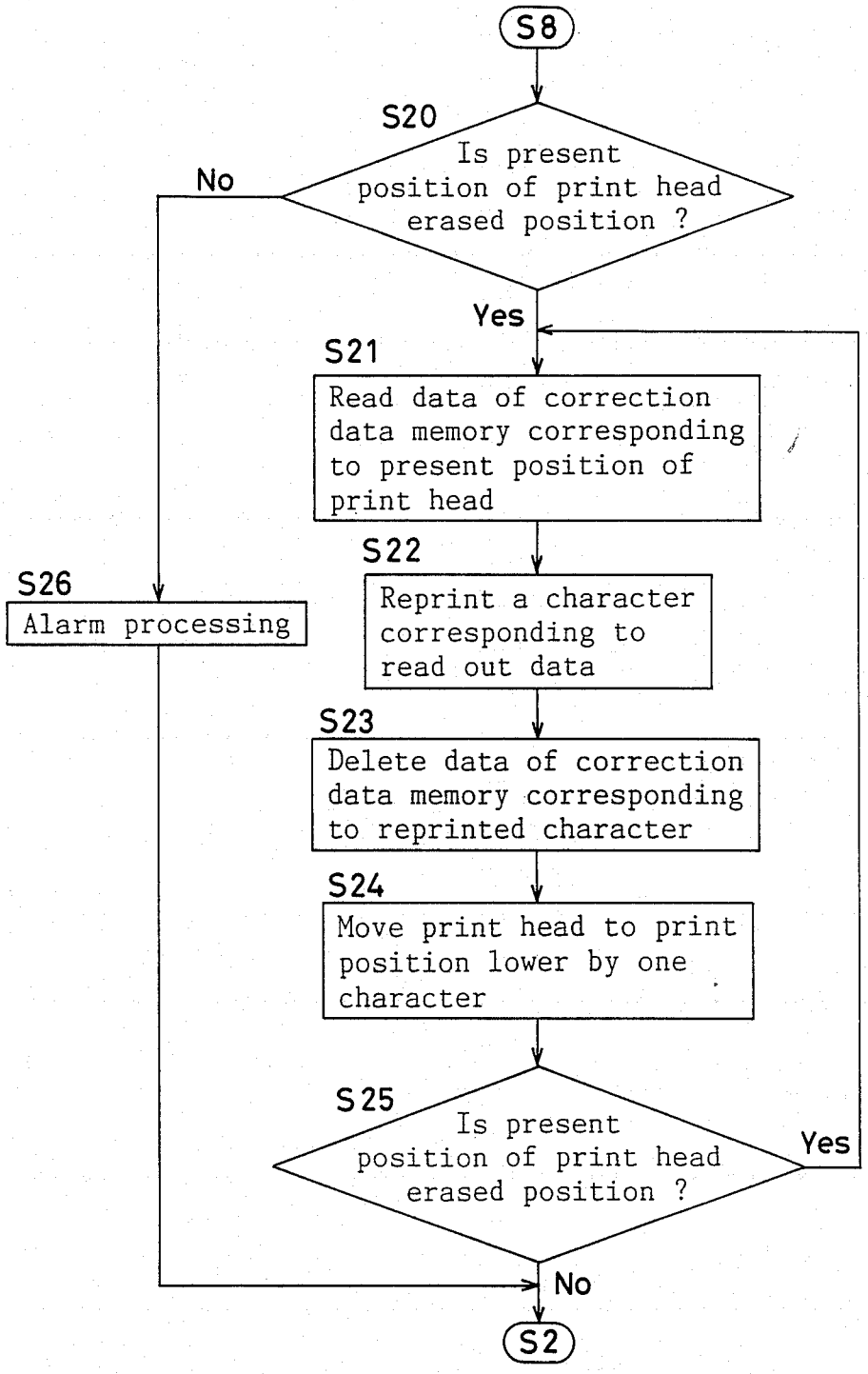
FIG. 7 and 8 are flow charts of a reprint processing routine in the first example of the reprint control, FIGS. 9(*a*), (*b*) and (*c*) are views corresponding to FIGS. 5(*a*), (*b*) and (*c*) in a second example of the reprint control.

Next, the reprint processing control routine conducted in the control system of the electronic type writer 1 will be described with reference to flow charts of FIGS. 6 and 7.

When the typewriter is energized, the control is started and it is initialized in the step S1 (hereinafter indicated merely as S1, similarly in other steps).

Then, in S2, it is determined whether or not the key input has been made (whether or not the key on the key-board 3 is operated), when it is not operated, S2 is repeated at every fine period of time till it is operated and it proceeds to S3 thereafter.

In S3, it is determined whether or not the key operated is the character keys 4, 5, 6, if Yes control moves to S4, wherein the character or symbol corresponding to the operated keys 4, 5, 6 is printed on the print paper 17 and it returns to S2.

In the case aforementioned, the CPU 46 outputs the control signal corresponding to the input code data to each driver 39, 47–51 of the printing mechanism drive means PM, by processing the code data inputted from various character keys 4, 5, 6 on the key-board 3 with the control program read out from the program memory 100 in the ROM 53.

Also, it if is determined No in S3 or the key other than the character keys 4, 5, 6 is operated, in S5, it is determined whether or not the correction key 23 is operated, if Yes, it proceeds to S6 and if No, it proceeds to S8.

In S6, on the basis of data of the present position memory 112, type position memory 114 and print data memory 110, correction processing (erase processing) is executed. In the correction processing, if the correction key 23 is pressed continuously, by its self repeating function, character erasing is commenced from the printed character corresponding to the print head, and executed continuously in the counter printing direction, thus erasing one character by operating the correction key 23 once.

Thus, though not shown in the flow chart, when the correction key 23 and code key 11 are operated simultaneously, erasing is executed in one word unit corresponding to the print head.

In S7, the correction data corresponding to the erased character erased in S6 are stored in the correction data memory 116 corresponding to the print position, and it returns to S2.

When the key other than the character keys 4, 5, 6 and correction key 23 is operated, in S8, it is determined whether or not it is the correction cancel key 60, if Yes, it proceeds to S10 to execute processing corresponding to the function key according to the operated function key.

The reprint processing routine in S9 will be described with reference to a flow chart of FIG. 7. In S20, on the basis of data of the present position memory 112 and correction data memory 116, it is determined whether or not the present position of the print head is at the erased print position, or corresponding to the print position of any of the character of the erased character string, if Yes, it moves to S21, if No, it moves to S26 to execute alarm processing which displays alarm on a buzzer or an alarm lamp and it returns to S2 therefrom.

In S21, on the basis of data of the present position memory 112 and correction data memory 116, the data of which corresponding to the present position of the print head is read out. In next S22, a character corresponding to the data of correction data memory 116 read out in S21 is reprinted. In this case, the CPU 46 outputs the control signal to the ribbon lift motor driver 50, ribbon feed motor driver 49, type wheel drive motor driver 51 and print hammer solenoid driver 39.

Then, in S23, the data of correction data memory 116 corresponding to the character reprinted in S22 is deleted. Next, in S24, the print head is moved to the print position lower (in the printing direction: toward right) by one character. In this case, the CPU 46 outputs the control signal to the carriage drive motor driver 48.

In next S25, it is determined whether or not the present position of the print head is at the erased print position, if Yes, it proceeds to S21, if No, it returns to S2. That is to say, when reprinting the character string comprising a plurality of characters, S21–S25 is repeated, and when the end character of the character string is reprinted, it is determined No in S25 and it returns to S2.

As described hereinabove, in the reprint control, the character on and after any character of the erased character string can be reprinted.

In addition, it may be so arranged that, when the correction cancel key 60 is operated while erasing the word unit by simultaneously operating the code key 11 and correction key 23, the erase operation is suspended halfway and the erased characters are reprinted at the original positions.

Next, modified example of the reprint control will be described.

In this control, after moving the print head automatically to the print position where the head character of the erased character string has been printed, it is reprinted sequentially from the head character.

Figure 8:
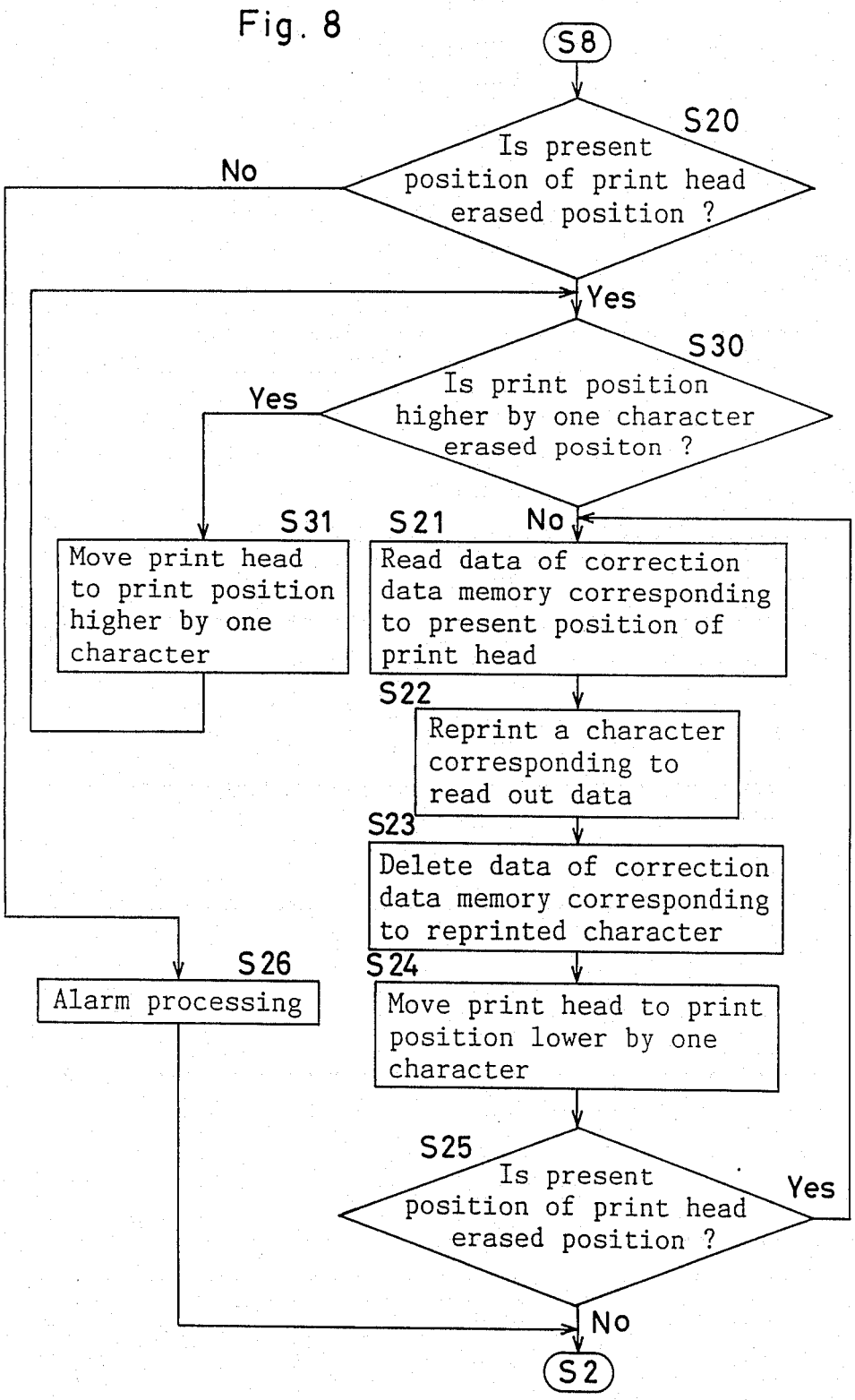

Referring to the flow chart of FIG. 8, explanation on S20–S26 will be omitted as they are same as the flow chart of FIG. 7, and S30–S31 which are newly added will be described.

If the present position of the print head when the correction cancel key 60 is operated is at the erased print position, it proceeds from S20 to S30, wherein on the basis of data of the present position memory 112 and correction data memory 116, it is determined whether or not the print position higher (counter printing direction) by one character of the present print head is the erased print position, if Yes, it proceeds to S31.

In next S31, the control signal is outputted to the carriage drive motor driver 48 to move the print head to the print position higher by one character and it returns to S30. When S30–S31 is repeated and the print head reaches the print position of the head character of the character string, in S30, it is determined No and it proceeds from S30 to S21 to execute steps including and following S21 and the erased character string is reprinted sequentially from its head character. [EXAMPLE 2 OF THE REPRINT CONTROL]

(FIG. 9–FIG. 12)

Figure 9:
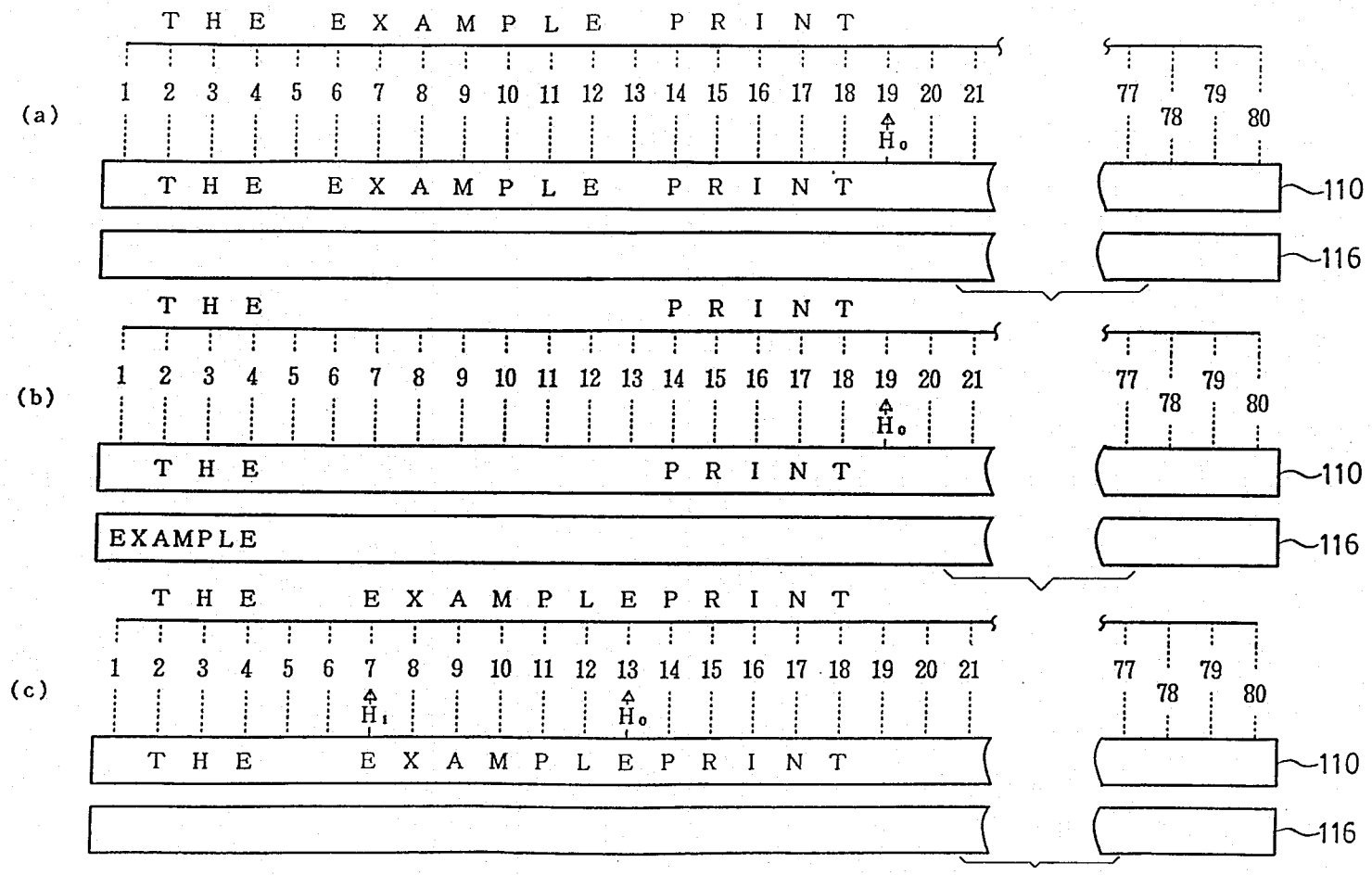

As shown in FIG. 9, in this case of reprint control, correction data memory 116 stores sequentially the data of a plurality of erased character strings without corresponding to the print position.

On every operation of the correction cancel key 60, by means of searching the data stored in the correction data memory 116 from upper digit to lower digit, the data of an erased character string sectioned by two space codes at both sides and erased last among plural erased character strings is detected and reprinted at the positions including and following the present position of the print head.

For a better understanding of the explanation, of the flow charts, the outline of reprint control will be described.

FIG. 9(*a*) visually shows the character string printed as "THE EXAMPLE PRINT" as one example corresponding to the data in the print data memory 110 and that in the correction data memory 116.

As shown in FIG. 9(*b*), the print head is moved from $H_O$ at 19th digit to 12th digit and the correction key 23 is continuously pressed to erase the character string "EXAMPLE" extending from 12th digit to 6th digit in the counter printing direction. At this time, the CPU 46 reads the erase processing control program from the program memory 100, repeats to print the same character upon the printed character at the print position corresponding to the present print head through the correction ribbon 44, and sequentially erases the character string "EXAMPLE" in the counter printing direction. Then the erased character string "EXAMPLE" is stored in the correction data memory 116, after moving the print head to 7th digit, string "EXAMPLE" is reprinted by operating the correction cancel key 60, as shown in FIG. 9(*c*), the CPU 46 reads the reprint control program from the program memory 100, and reprinted the character string "EXAMPLE" stored in the correction data memory 116 from the present position of the print head. Because FIGS. 9(*a*) and (*b*) are same as FIGS. 5(*a*) and (*b*) respectively, their explanations are omitted.

Then, the data of the correction data memory 116 corresponding to the reprinted character string "EXAMPLE" are erased.

Figure 10:
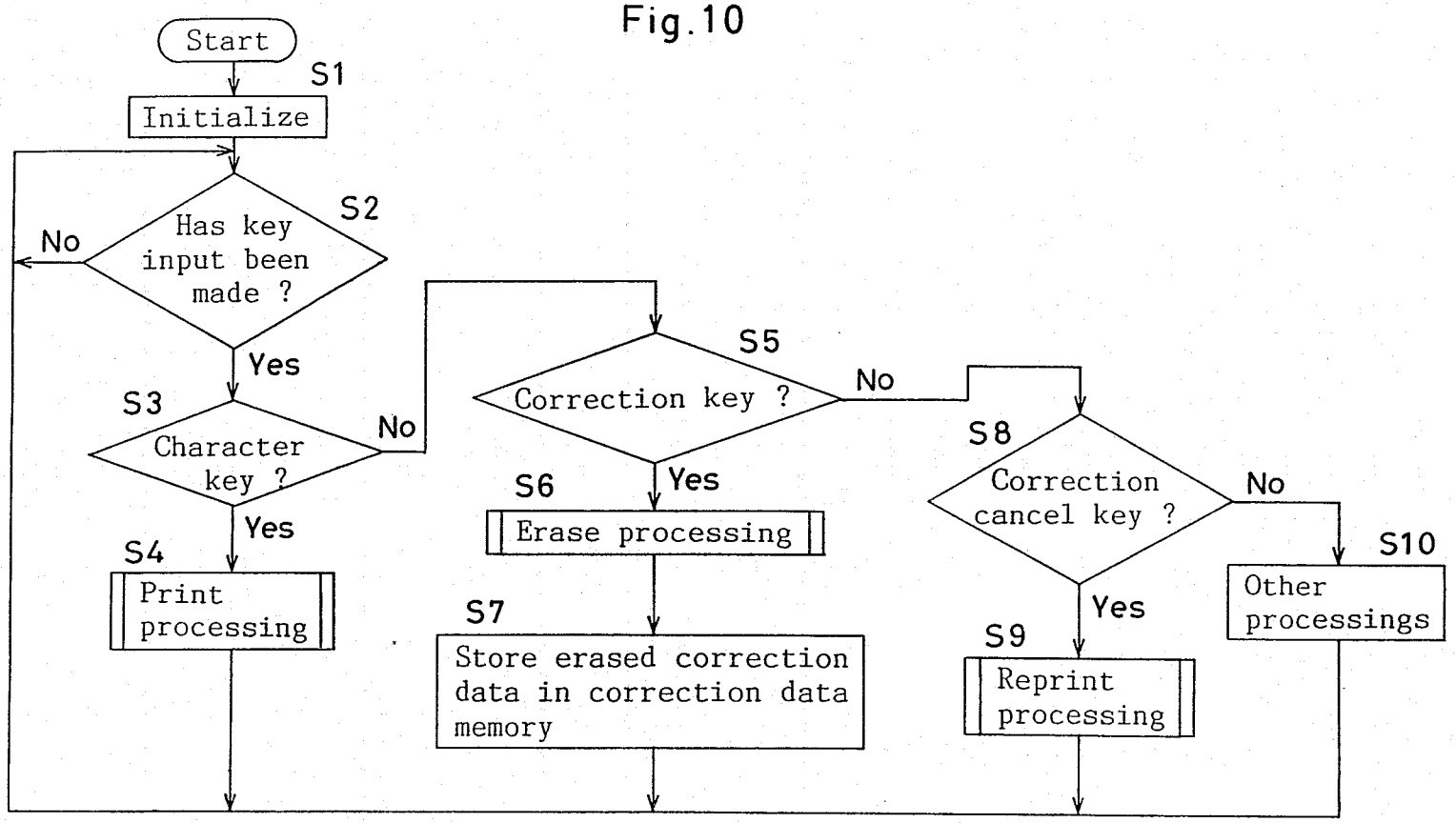
FIG. 10 is a view corresponding to FIG. 6 in the second example of the reprint control.
Figure 11:
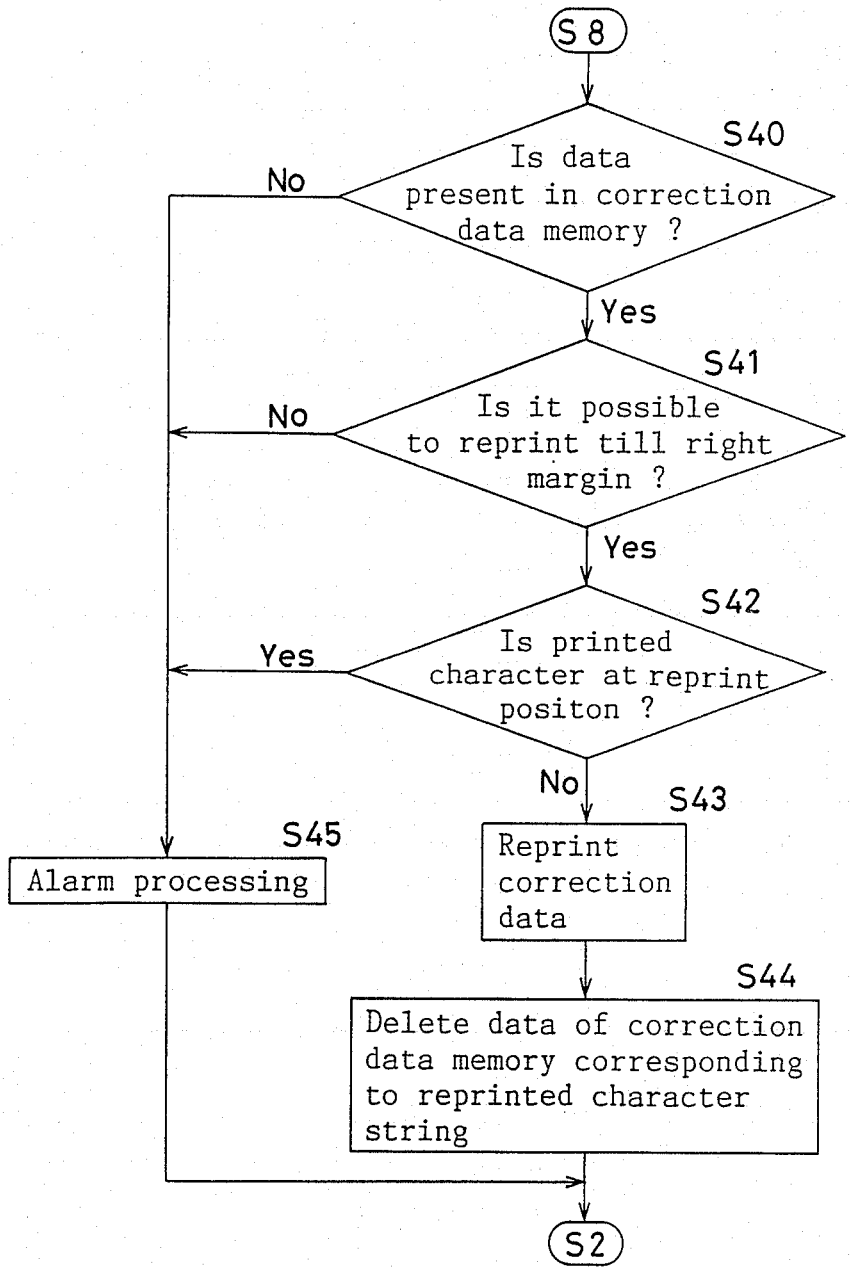
FIGS. 11 and 12 are flow charts of the reprint processing routine of FIG. 10, FIGS. 13(*a*), (*b*) and (*c*) are views corresponding to FIGS. 5(*a*), (*b*) and (*c*) in a third example of the reprint control.
Figure 12:
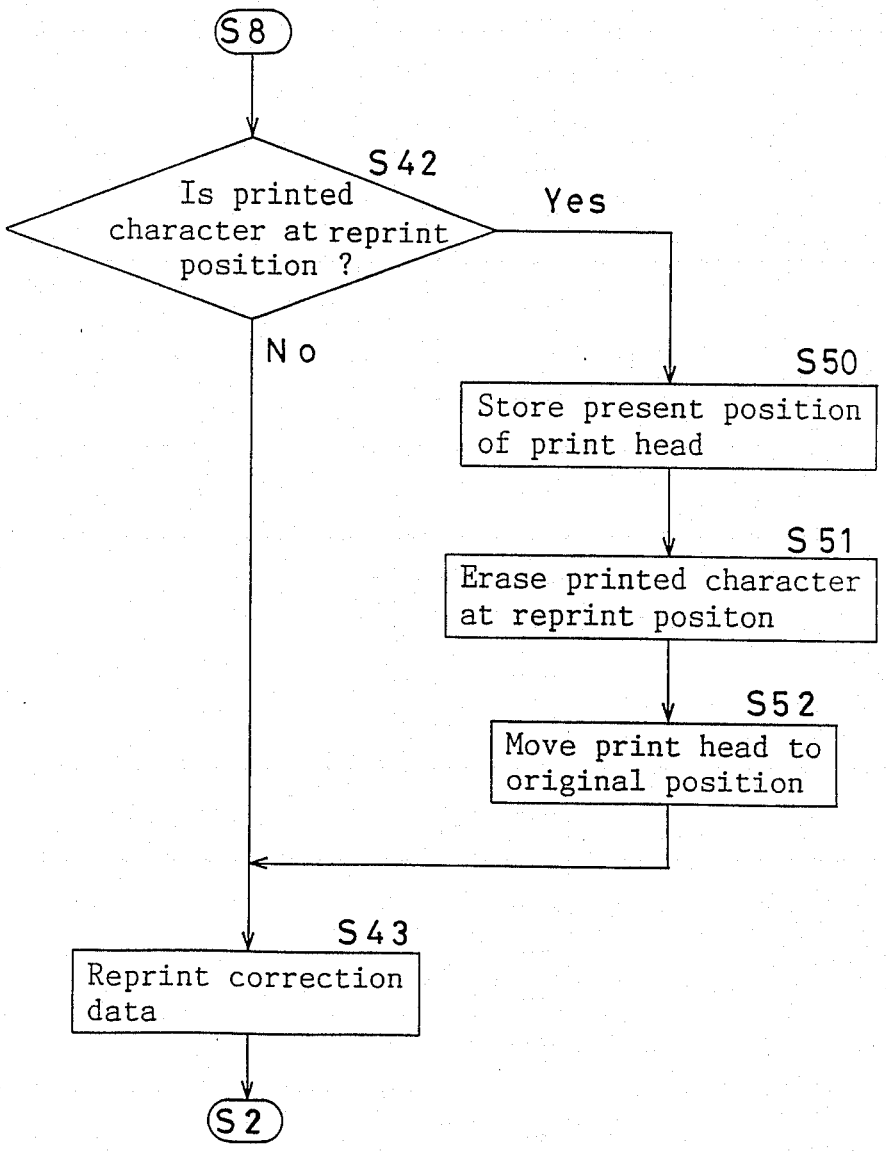

The reprint control routine is shown in FIG. 10 through FIG. 12.

The routine of FIG. 10, however, is as same as Example 1 except of S7, therefore, explanation on steps other than S7 will be omitted.

That is to say, in S7, correction data of a plurality of character strings corresponding to erased characters erased at every erasing in S6 are sequentially stored in the correction data memory 116, and it returns to S2.

The reprint processing routine in S9 of FIG. 10 will be explained with reference to a flow chart of FIG. 11. In S40, on the basis of data of the correction data memory 116 in RAM 54, it is determined whether or not the correction data is present, if Yes, it proceeds to S41, if No, it proceeds to S45 to execute alarm processing which displays alarm on a buzzer or an alarm lamp or the like and returns from S45 to S2.

In S41, on the basis of data of the right margin memory 118, correction data memory 116 and present position memory 112, it is determined whether or not the character string of the correction data to be reprinted can be printed within the range from the present position of the print head to the right margin set position, if Yes, it proceeds to S42, and if No, it proceeds to S45 to execute alarm processing and returns to S2.

In S42, on the basis of data of the correction data memory 116 and print data memory 110, it is determined whether or not the print character is present in respective reprinting position of the character string to be reprinted, if No, it moves to S43, if Yes, it moves to S45 to execute alarm processing and returns to S2.

In S43, on the basis of data of the present position memory 112 and correction data memory 116, the character string data erased lastly among the correction data are reprinted at the positions including and following the present position of the print head. In this case, the CPU 46 outputs the control signal to each driver 39, 48–51 necessary for printing operation.

In next S44, the data of the correction data memory 116 corresponding to the character string reprinted in S43 are deleted and it returns to S2. At this time, in the correction data memory 116, the data erased and stored just before the character string just reprinted becomes the data of the character string erased lastly.

Now, it may be constructed in such a manner that, steps of S42 and S43 are modified as shown in FIG. 12 and when it is determined Yes in S42 or when the printed character is present at the print position to be reprinted, the printed character is erased by the following steps S50–S52.

That is to say, when the printed character is present at the reprint position, it moves form S42 to S50, wherein on the basis of data of the present position memory 112, the present position of the print head is stored in the reprint start memory (not shown) in the RAM 54.

In next S51, on the basis of each data of the print data memory 110, correction data memory 116 and present position memory 112, and by controlling an erasing mechanism, the printed characters printed at the reprint positions are erased.

Then, in next S52, the print head is moved to the stored reprint start position and it proceeds from S52 to S53 to execute steps thereafter.

In addition, in S51, among the printed characters to be erased, if the character and its print position is same as the one to be reprinted in S53, said character may be left unerased.

[EXAMPLE 3 OF THE REPRINT CONTROL]

(FIG. 13–FIG. 16)

In this reprint control, the data of the character string erased (corrected) by operating the correction key 23 are stored in the correction data memory 116 corresponding to the print position. Then, after starting erasing operation, the character string stored in the correction data memory 116 while the key is not operated are processed for reprint.

For better understanding of the explanation on flow charts, the outline of reprint processing control will be described.

Figure 13:
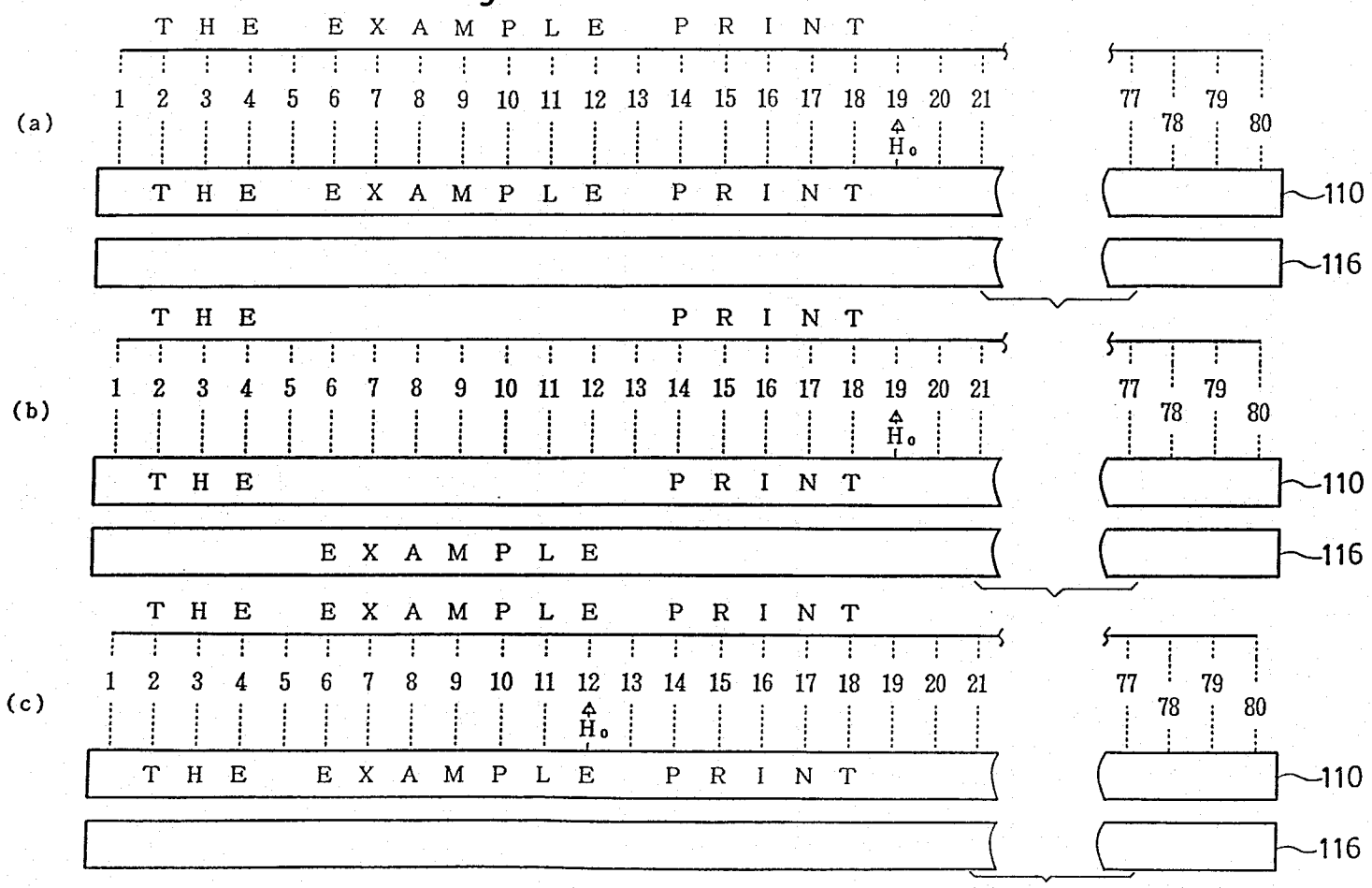

FIG. 13(*a*) visually shows the character string printed as "THE EXAMPLE PRINT" as one example corresponding to the data of the print data memory 110 and that of the correction data memory 116.

As shown in FIG. 13(*b*), the print head is moved from $H_O$ at 19th digit to 12th digit, and the correction key 23 is pressed continuously to erase the character string "EXAMPLE" extending from 12th digit to 6th digit in the counter printing direction. At this time, the CPU 46 reads the erase processing control program from the program memory 100, repeats to print the same character upon the printed character at the print position corresponding to the present print head through the correction ribbon 44, and erases the character string "EXAMPLE" as well as writes 1 in a correction flag 120 to set it. Then, the data of the erased character string "EXAMPLE" are stored in the correction data memory 116 corresponding to the print position. The correction flag 120 is reset when operating any of the keys on the keyboard 3 after operating the correction key 23.

Now, when the correction cancel key 60 is operated and the correction flag 120 is set, or when the correction cancel key 60 is operated after operating the correction key 23, the correction cancel key 60 becomes effective, and as shown in FIG. 13(*c*), the CPU 46 reads the reprint processing control program from the program memory 100 and reprints the character string "EXAMPLE" stored in the correction data memory 116 at the respective print position from there previously erased.

Then, the data of the correction data memory 116 corresponding to the reprinted character string "EXAMPLE" are deleted.

Figure 14:
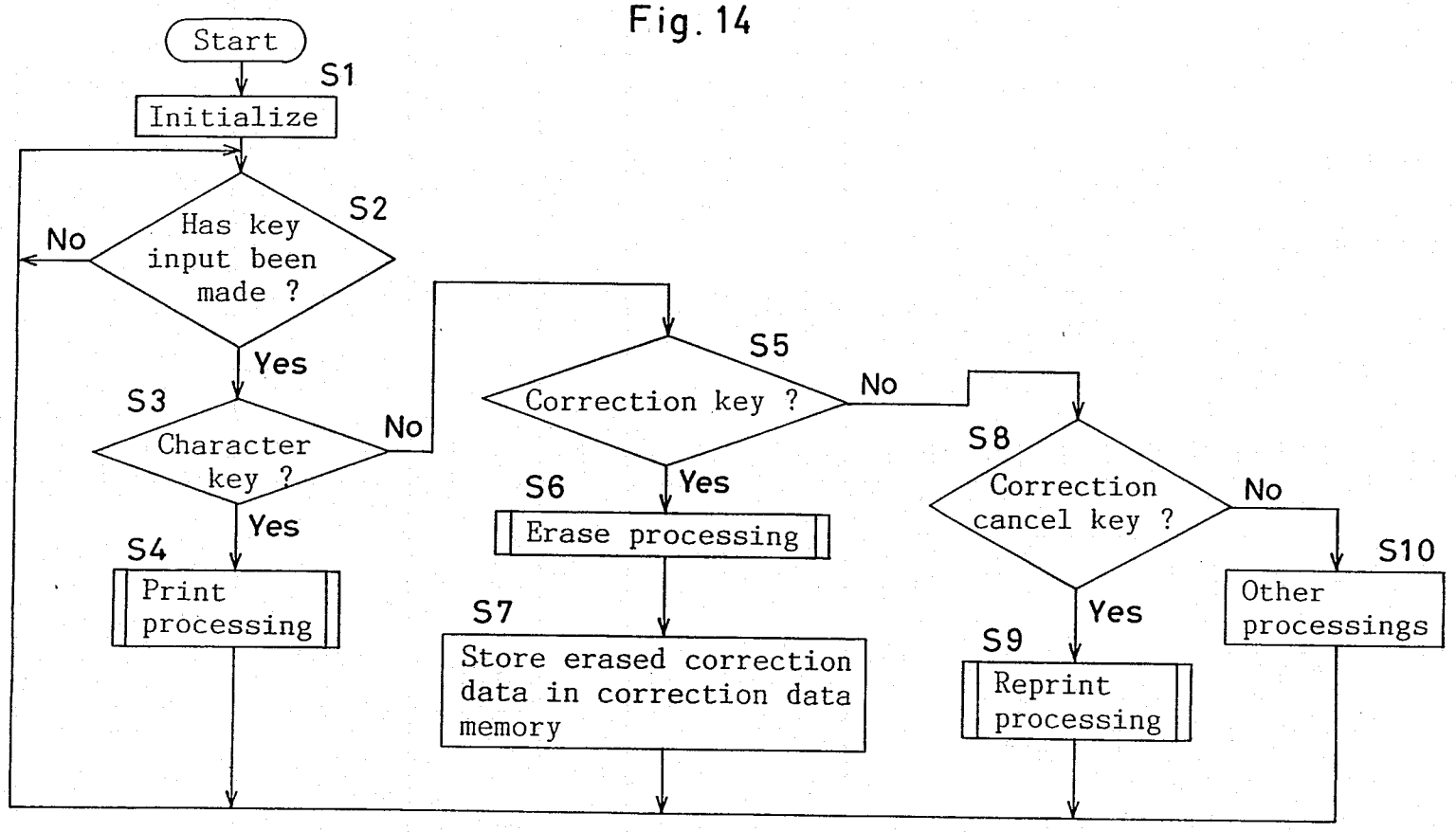
FIG. 14 is a view corresponding to FIG. 6 in the third example of the reprint control.
Figure 16:
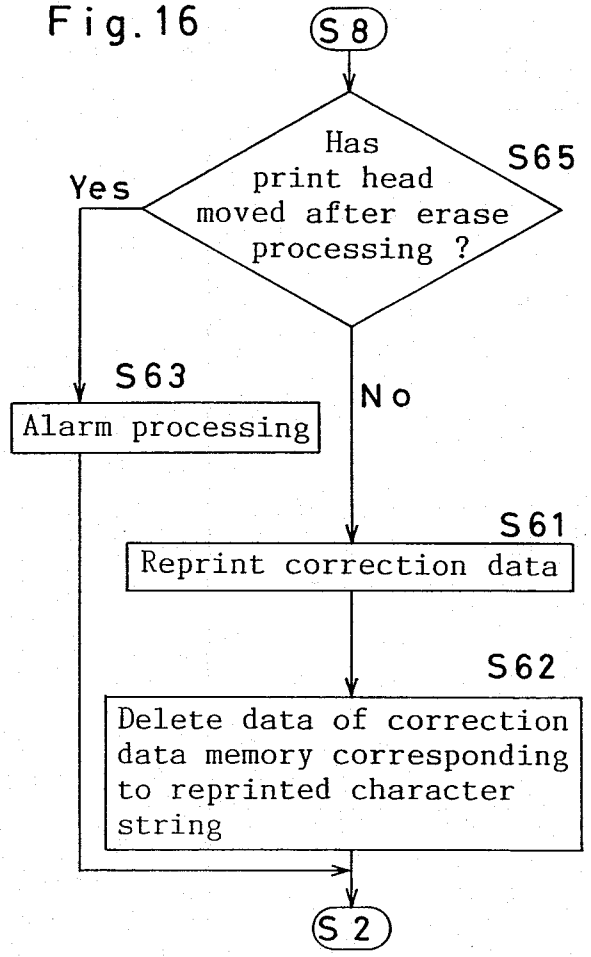
FIGS. 15 and 16 are flow charts of the reprint processing routine of FIG. 14.
Figure 15:
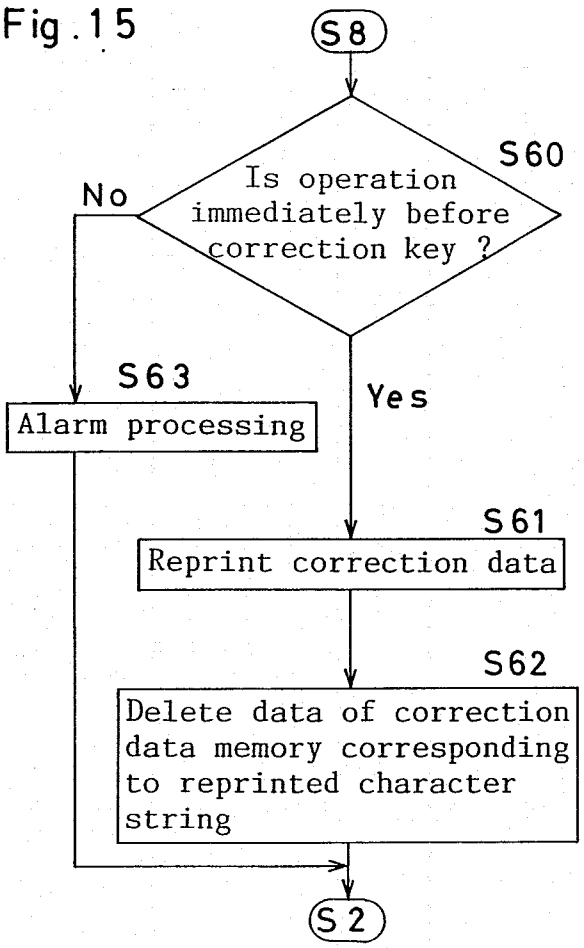

The reprint control routine is shown in FIG. 14 through FIG. 16. The routine of FIG. 14, however, is as same as FIG. 5 of Example 1 mentioned hereinbefore, so its explanation will be omitted.

The reprint processing routine in S9 of FIG. 14 will be explained with reference to a flow chart of FIG. 15. In S60, on the basis of data of the correction flag 120, it is determined whether or not the operation just before the correction cancel key 60 operation is the correction key 23 operation, if Yes (if the correction flag 120 is set), it proceeds to S61, if no (if the correction flag is reset), it proceeds to S63 to execute alarm processing which displays alarm on a buzzer or an alarm lamp or the like, and returns from S63 to S2.

In S61, on the basis of data of the present position memory 112 and correction data memory 116, the correction data are sequentially reprinted. In next S62, the correction data of the correction data memory 116 corresponding to the character string reprinted in S61 are deleted and it returns to S2.

As described hereinabove, in the reprint control mentioned above, when the key is not operated after starting the erase operation, the character string is reprinted at the same print position previously erased.

Next, a modified example of the above reprint control will be explained.

In the modified example of the reprint control, the character string is reprinted at the respective print position from there previously erased when the print head is not moved after completing erase operation, wherein function of the correction flag 120 and the reprint processing routine are only different.

Though the reprint processing routine will be explained with reference to a flow chart of FIG. 16, since steps S61–S63 are same as the flow chart of FIG. 15, its explanation will be omitted and S65 provided in place of S60 of FIG. 15 and the correction flag 120 will be explained.

The correction flag 120 is arranged to be set when the operation of correction key 23 is started and reset when the print head is moved after completing the erasing operation.

It proceeds from S8 to S65, wherein on the basis of data of the correction flag 120, it is determined whether or not the print head is moved after completing the erasing operation, if Yes (if the correction flag 120 is reset), it proceeds to S63, if No (if the correction flag 120 is set), it proceeds to S61 to execute steps on and after S61 and the character string is reprinted.

As explained hereinabove, in the above reprint control, when the print head is not moved after completing erasing operation, the character string is reprinted at the respective print position from there previously erased.

[EXAMPLE 4 OF THE REPRINT CONTROL]

(FIG. 17–FIG. 20)

Figure 17:
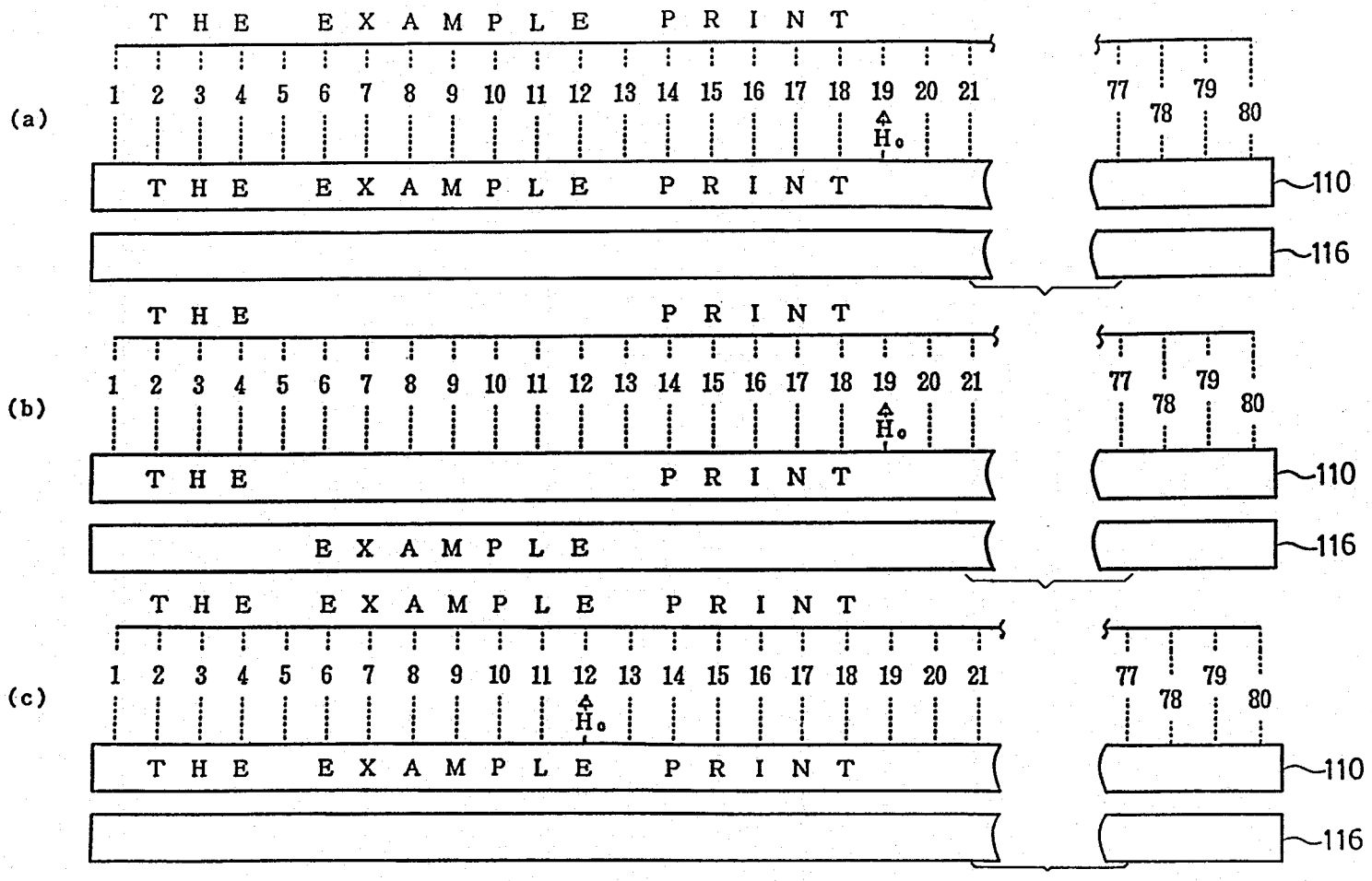
FIGS. 17(*a*), (*b*) and (*c*) are views corresponding to FIGS. 5(*a*), (*b*) and (*c*) in a fourth example of the reprint control.

As shown in FIG. 17, in this case of reprint control, correction data memory 116 stored sequentially the data of a plurality of erased character strings corresponding to respective print positions.

On every operation of the correction cancel key 60, by means of searching the data stored in the correction data memory 116 from upper digit to lower digit, the data of the last erased character string among plural erases character strings is detected and reprinted.

For a better understanding of the explanation on flow charts, the outline of reprint control will be explained.

FIG. 17(*a*) visually shows the character string printed as "THE EXAMPLE PRINT" as one example corresponding to the data in the print data memory 110 and that in the correction data memory 116.

As shown in FIG. 17(*b*), the print head is moved from $H_O$ at 19th digit to 12th digit and the correction key 23 is continuously pressed to erase sequentially the character string "EXAMPLE" extending from 12th digit to 6th digit in the counter printing direction. At this time, the CPU 46 reads the erase processing control program from the program memory 100, repeats to print the same character upon the printed character at the print position corresponding to the present print head through the correction ribbon 44 and erases the character string "EXAMPLE" sequentially.

Then, the data of the erased character string "EXAMPLE" is stored in the correction data memory 116 corresponding to the print position.

Now, when the erased character string ∂EXAMPLE" is reprinted by operating the correction cancel key 60, as shown in FIG. 17(*c*), the CPU 46 reads the reprint processing control program from the program memory 100, and reprints the character string "EXAMPLE" stored in the correction data memory 116 extending from 6th digit to 12th digit at the respective print position from there previously erased.

Then, the data of the correction data memory 116 corresponding to the reprinted character string "EXAMPLE" are deleted.

Figure 18:
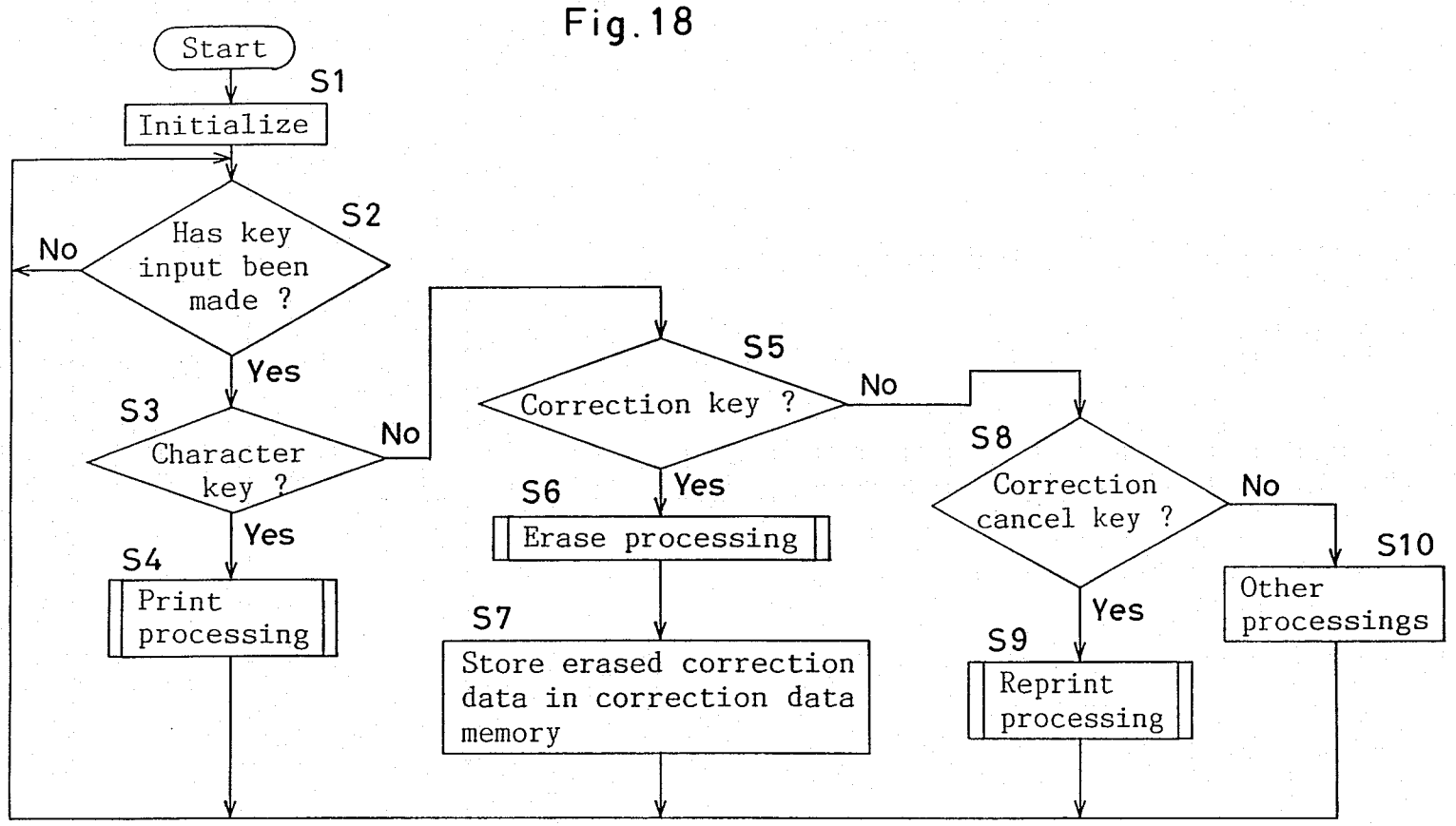
FIG. 18 is a view corresponding to FIG. 6 in the fourth example of the reprint control.
Figure 19:
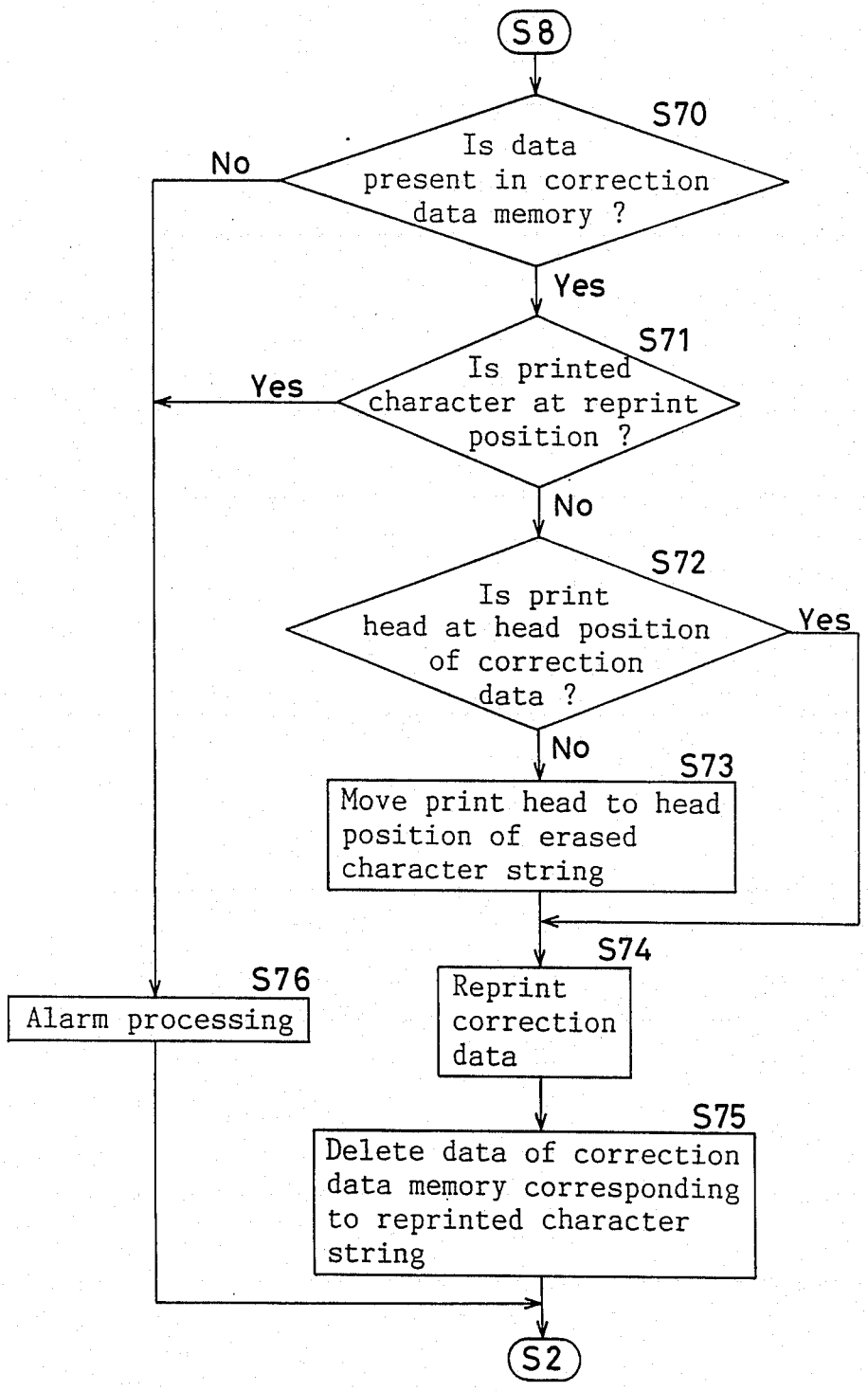
FIGS. 19 and 20 are flow charts of the reprint processing routine of FIG. 18.
Figure 20:
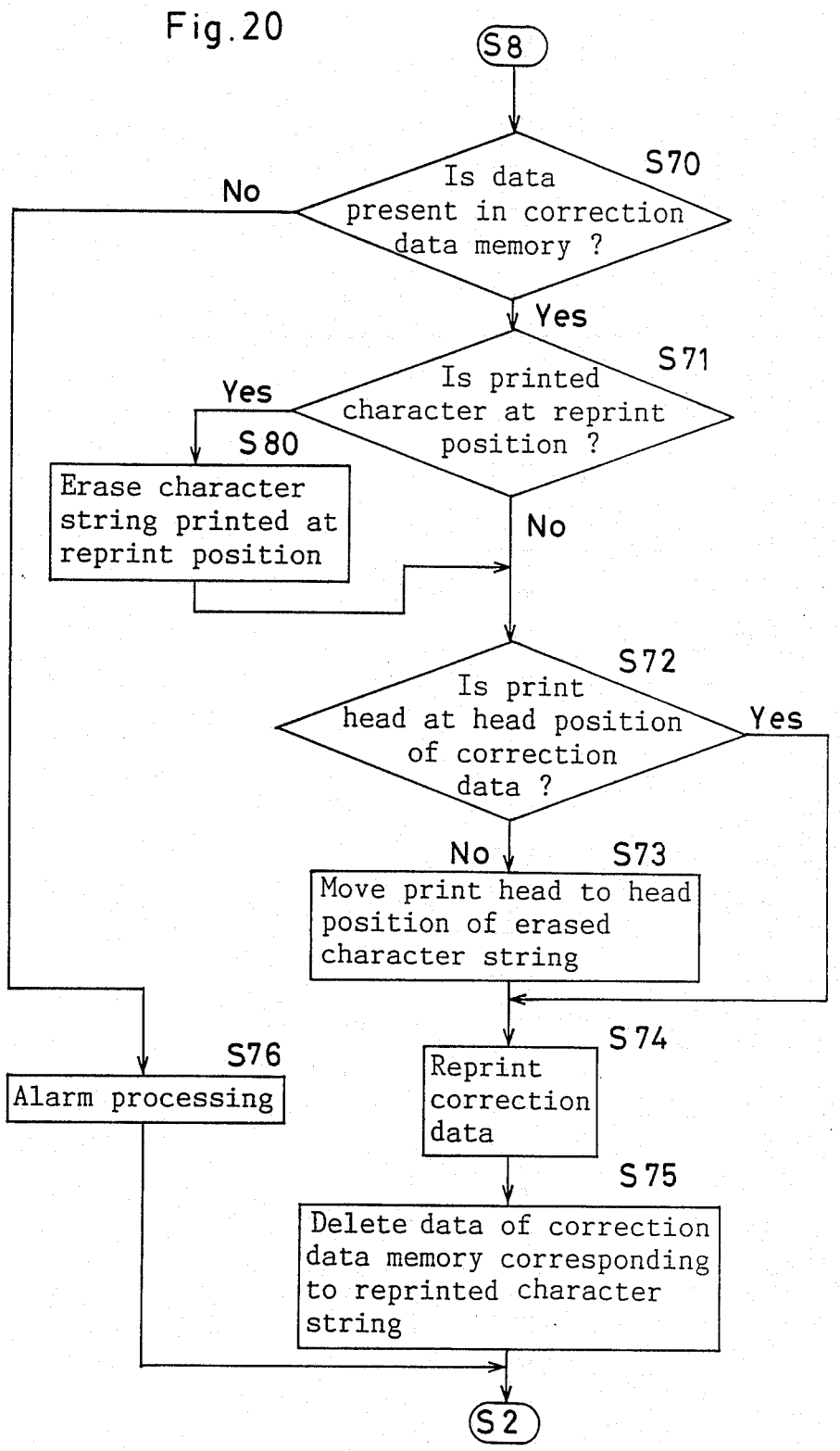

The reprint control routine is shown in FIG. 18 through FIG. 20. The routine of FIG. 18, however, is same as that of Example 1 except of S7, therefore, the explanation on steps other than S7 will be omitted.

That is to say, in S7, a plurality of correction data corresponding to the erased character erased at every erasing in S6 are stored in the correction data memory 116 corresponding to the print position, and it returns to S2.

The reprint processing routine in S9 of FIG. 18 will be explained with reference to a flow chart of FIG. 19. In S70, on the basis of data of the correction data memory 116 in the RAM 54, it is determined whether or not the correction data is present, if Yes, it proceeds to S71, if No, it proceeds to S76 to execute alarm processing which displays alarm on a buzzer or an alarm lamp or the like, and returns from S76 to S2.

In S71, on the basis of data of the correction data memory 116 and print data memory 110, it is determined whether or not the print character is present at respective reprint position of the character string to be reprinted, if No, it proceeds to S72 and if Yes, it proceeds to S76 to execute alarm processing and returns to S2.

In S72, on the basis of data of the present position memory 112 and correction data memory 116, it is determined whether or not the present position of the print head is at the print position of the head character of the correction data, if No, it moves to S73 and if Yes, it moves to S74.

In S73, by controlling the printing mechanism on the basis of data of the present position memory 112 and correction data memory 116, the print head is moved to the print position of the head character of the correction data.

In the aforementioned case, when the correction data corresponds to a print line before the print line corresponding to the present print head position, the print paper 17 is fed reversely and the print head is moved to the print position of the head character of the character string. At this time, the CPU 46 outputs the control signal to the carriage drive motor driver 48 and platen drive motor driver 47.

In next S74, on the basis of data of the correction data memory 116, the latest correction data are reprinted sequentially. In next S75, the correction data of the correction data memory 116 corresponding to the character string reprinted in S74 is deleted, and it returns to S2.

In the case aforementioned, in the correction data memory 16, a data erased and stored just before the character string just reprinted becomes the data of the lastly erased character string or the latest correction data.

As explained heretofore, in the reprint control mentioned above, among the character strings stored in the correction data memory 116, the lastly erased character string can be firstly reprinted at the respective print position from there previously erased.

Now, a modified example of the reprint control will be explained. In this reprint control, when the printed character is present at the reprinted position, the printed character is erased before reprinting.

Next, though the reprint processing routine will be explained with reference to a flow chart of FIG. 20, since steps S70–S76 are same as that in the flow chart of FIG. 19, the explanation thereof will be omitted and only S80 newly added will be explained.

When the printed character is present at respective print position of the character string to be reprinted, it proceeds from S71 to S80, wherein by controlling the erasing mechanism on the basis of data of the present position memory 112, print data memory 110 and correction data memory 116, the characters printed at reprint position are erased, and it proceeds from S80 to S72 to execute steps including and following S72 and the erased character string is reprinted at the respective print position from there previously erased.

In addition, in S80, among the printed character to be erased, when the character and its print position is same as the one to be reprinted in S74, the character may be left unerased.

Meanwhile, though the above embodiment has been explained as to the typewriter including a daisy wheel type printer, it will be appreciated that the present inventions may be similarly applied to the typewriter having a thermal printer or to the typewriter having a type ball type printer as well.

What is claimed is:

1. A character erasable printing apparatus comprising:

input means for inputting data of characters and symbols, and having an erase command key for inputting an erase command signal;

a printing mechanism for printing said characters or symbols inputted from said input means on a printing medium;

a print data memory for storing data of printed characters and symbols corresponding to a respective print position;

a present position memory for storing the present position of a print head of said printing mechanism corresponding to a respective print position;

an erasing mechanism, starting operation by said erase command signal from said erase command key, for erasing sequentially each character printed with said printing mechanism to erase a character string;

an erase data memory for storing data of a character string erased by said erasing mechanism corresponding to a respective print position;

an erase control command key disposed on said input means for inputting an erase cancel command signal; and reprint control means which, when receiving said erase cancel command signal, and said print head's position corresponds to the print position of any character of said erased character string, controls said printing mechanism on the basis of the data of said present position memory and said erase data memory, to reprint at least a part of the characters of said erased character string beginning with any character within the erased character string at the respective print position from which they were previously erased.

2. A character erasable printing apparatus according to claim 1; wherein said reprint control means controls said printing mechanism to reprint characters including and following the character corresponding to said print head's position of said erased character string.

3. A character erasable printing apparatus according to claim 1; wherein said reprint control means controls said printing mechanism to move said print head to the print position of the head character of said erased character string, and to reprint all characters of said erased character string.

4. A character erasable printing apparatus according to claim 3; wherein said reprint control means detects whether or not key input has been made from said input means after starting of erasing operation by said erasing mechanism, and controls to reprint said erased character string only when it is detected that said key input has not been moved.

5. A character erasable printing apparatus according to claim 3; wherein said reprint control means detects whether or not said print head has been moved relative to said printing medium after completion of erasing operation by said erasing mechanism, and controls to reprint said erased character string only when said print had has not been moved.

6. A character erasable printing apparatus comprising:

input means for inputting data of characters and symbols, and having an erase command key inputting an erase command signal;

a printing mechanism for printing said characters or symbols inputted from said input means on a printing medium;

a print data memory for storing data of printed characters and symbols corresponding to a respective print position;

a present position memory for storing the present position of a print head of said printing mechanism corresponding to a respective print position;

an erasing mechanism, starting operation by said erase command signal from said erase command key, for erasing sequentially each character printed with said printing mechanism to erase a character string;

an erase data memory for sequentially storing data of a plurality of character strings erased by said erasing mechanism;

a reprint command key disposed on said input means for inputting a reprint command signal; and reprint control means which, when receiving said reprint command signal, controls said printing mechanism on the basis of the data of said erase data memory, to reprint sequentially from the lastly erased character string of said plurality of erased character strings stored in said erase data memory at print positions including and following the print position corresponding to the print head's position and controls said erase data memory to delete data of reprinted character string.

7. A character erasable printing apparatus according to claim 6; wherein said reprint control means detects whether or not a printed character is present at the print positions to be reprinted on the basis of the data of said print data memory, and controls said erasing mechanism, when said printed character is present, to erase said printed character before reprinting.

8. A character erasable printing apparatus comprising:

input means for inputting data of characters and symbols, and having an erase command key for inputting an erase command signal;

a printing mechanism for printing said characters or symbols inputted from said input means on a printing medium;

a print data memory for storing data of printed characters and symbols corresponding to a respective print position;

a present position memory for storing the present position of a print head of said printing mechanism corresponding to a respective print position;

an erasing mechanism, starting operation by said erase command signal inputted from said erase command key, for erasing sequentially each character printed with said printing mechanism to erase a character string;

an erase data memory for sequentially storing the data of a plurality of character strings erased by said erasing mechanism corresponding to a respective print position;

an erase cancel command key disposed on said input means for inputting an erase cancel command signal; and reprint control means which, when receiving said erase cancel command signal, controls said printing mechanism on the basis of the data of said present position memory and said erase data memory, to reprint sequentially for the last erased character string of said plurality of said erased character strings at print positions from which they were previously erased, and controls said erase data memory to delete data of said reprinted character string.

9. A character erasable printing apparatus according to claim 8; wherein said reprint control means detects whether or not a printed character is present at the print positions to be reprinted on the basis of the data of said print data memory, and controls said erasing mechanism, when said printed character is present, to erase said printed character before reprinting.

10. A character erasable printing apparatus comprising:

input means for inputting data of characters and symbols, and having an erase command key inputting an erase command signal;

a printing mechanism for printing said characters or symbols inputted from said input means on a printing medium;

a print data memory for storing data of printed characters and symbols corresponding to a respective print position;

a present position memory for storing the present position of a print head of said printing mechanism corresponding to a respective print position;

an erasing mechanism, starting operation by said erase command signal from said erase command key, for erasing sequentially each character printed with said printing mechanism to erase a character string;

an erase data memory for sequentially storing data of a plurality of character strings erased by said erasing mechanism;

a reprint command key disposed on said input means for inputting a reprint command signal; and reprint control means which, when receiving said reprint command signal, controls said printing mechanism on the basis of the data of said erase data memory, to reprint an erased character string of said plurality of said erased character strings stored in said erase data memory at print positions including and following the print position corresponding to the print head's position, and said reprint control mean detects whether or not a printed character is present at the print positions to be reprinted on the basis of the data of said print data memory, and controls said erasing mechanism, when said printed character is present, to erase said printed character before reprinting.

* * * * *